US009085134B2

(12) United States Patent
Otokita

(10) Patent No.: US 9,085,134 B2
(45) Date of Patent: Jul. 21, 2015

(54) LINE PRINTER AND METHOD FOR CONTROLLING THE SAME

(71) Applicant: Seiko Epson Corporation, Tokyo (JP)

(72) Inventor: Kenji Otokita, Yamagata (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/471,478

(22) Filed: Aug. 28, 2014

(65) Prior Publication Data

US 2015/0062226 A1 Mar. 5, 2015

(30) Foreign Application Priority Data

Sep. 3, 2013 (JP) ..... 2013-181898

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04581; B41J 2/04588; B41J 2/04503; B41J 2/04541; B41J 2/04593; B41J 2/04598
USPC ..... 347/14–16, 19, 20, 54, 57, 60, 68, 70, 347/76
See application file for complete search history.

(56) References Cited

U.S. PATENT DOCUMENTS 7,150,513 B2 12/2006 Shinkawa et al.
8,243,328 B2 8/2012 Kasai et al.
2013/0321508 A1* 12/2013 Sano ..... 347/16

FOREIGN PATENT DOCUMENTS

JP 2004-276544 A 10/2004
JP 2008-284868 A 11/2008

* cited by examiner

*Primary Examiner* — Thinh Nguyen
(74) *Attorney, Agent, or Firm* — Harness, Dickey & Pierce, P.L.C.

(57) ABSTRACT

There is provided a line printer including: a nozzle that discharges liquid; a pressure chamber that communicates with the nozzle; a piezoelectric element that is provided to correspond to the pressure chamber and to discharge liquid; a pulse generation unit that generates a drive pulse to discharge liquid from the nozzle and an inspection pulse to inspect a liquid discharge state; and a residual vibration detection unit that detects residual vibration in the pressure chamber, which occurs after the inspection pulse is applied to the piezoelectric element. The drive pulse is caused to be applied to the piezoelectric element and the inspection pulse is caused not to be applied to the piezoelectric element at a first printing speed. The drive pulse and the inspection pulse are caused to be applied to the piezoelectric element at a second printing speed. The second printing speed is slower than the first printing speed.

6 Claims, 23 Drawing Sheets

EXPERIMENTAL VALUE AND CALCULATED VALUE OF RESIDUAL VIBRATION (NORMAL STATE)

EXPERIMENTAL VALUE AND CALCULATED VALUE OF RESIDUAL VIBRATION (BUBBLE)

EXPERIMENTAL VALUE AND CALCULATED VALUE OF RESIDUAL VIBRATION (DRY)

EXPERIMENTAL VALUE AND CALCULATED VALUE OF RESIDUAL VIBRATION (PAPER POWDER)

FIG. 17A

<FIRST MODE (FIRST PRINTING SPEED)>

| SI (b1, b2, b3) | Tc1 | | | Tc2 | | | Tc3 | | |
|---|---|---|---|---|---|---|---|---|---|
| | Sa | Sb | Sc | Sa | Sb | Sc | Sa | Sb | Sc |
| (1, 1, 0) | H | L | L | H | L | L | H | L | L |
| (1, 0, 0) | H | L | L | H | L | L | L | H | L |
| (0, 1, 0) | H | L | L | L | H | L | L | H | L |
| (0, 0, 0) | L | H | L | L | H | L | L | H | L |

FIG. 17B

| SI (b1, b2, b3) | Tc0 | | |
|---|---|---|---|
| | Sa | Sb | Sc |
| (1, 1, 1) | L | L | H |
| (1, 0, 1) | L | L | H |
| (0, 1, 1) | L | L | H |
| (0, 0, 1) | L | L | H |

<SECOND MODE (SECOND PRINTING SPEED)>

| SI (b1, b2, b3) | Tc1 | | | Tc2 | | | Tc3 | | |
|---|---|---|---|---|---|---|---|---|---|
| | Sa | Sb | Sc | Sa | Sb | Sc | Sa | Sb | Sc |
| (1, 1, 0) | H | L | L | H | L | L | H | L | L |
| (1, 0, 0) | H | L | L | H | L | L | L | H | L |
| (0, 1, 0) | H | L | L | L | H | L | L | H | L |
| (0, 0, 0) | L | H | L | L | H | L | L | H | L |

FIG. 28
| Flag | NTc (COMPARED CONTENT) | Rs |
|---|---|---|
| 1 | NTc < NTx1 | 2: ABNORMAL DISCHARGE (BUBBLE) |
| | NTx1 ≤ NTc ≤ NTx2 | 1: NORMAL |
| | NTx2 < NTc ≤ NTx3 | 3: ABNORMAL DISCHARGE (PAPER POWDER) |
| | NTx3 < NTc | 4: ABNORMAL DISCHARGE (THICKENING) |
| 0 | N/A | 5: ABNORMAL DISCHARGE |
FIG. 29
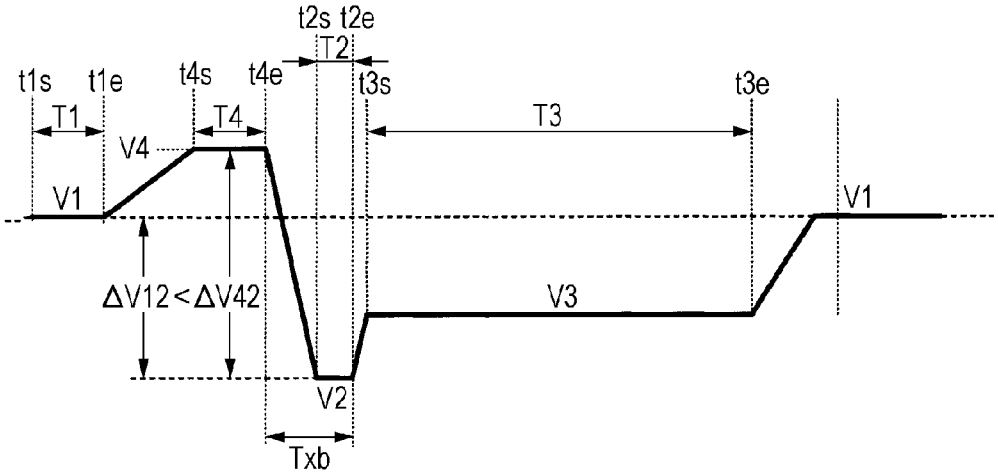
FIG. 30
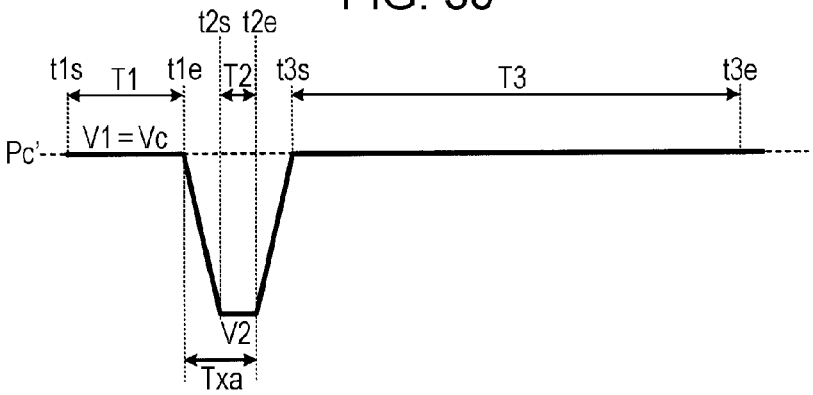

LINE PRINTER AND METHOD FOR CONTROLLING THE SAME

BACKGROUND

1. Technical Field

The present invention relates to a line printer and a method for controlling the same.

2. Related Art

An ink jet type line printer performs printing by discharging ink from the inside of a cavity. If ink dries, the ink is thickened. There is a case in which thickened ink in the cavity causes discharge failure. If nozzle omission in which it is difficult to discharge ink from a nozzle occurs, white stripes are recorded on a recording sheet corresponding to the nozzle failure. Here, JPA-2008-284868 discloses a method for detecting nozzle omission by analyzing image data which is acquired by imaging an ink discharge state.

Since the method is a consequence management performed after the nozzle omission occurs, it is difficult to detect a symptom of the nozzle omission and to avoid image quality being deteriorated. In order to solve the problem, there has been known a method for monitoring an ink discharge state before nozzle omission occurs by applying vibration to ink in a cavity using a piezoelectric element and detecting behavior of ink with regard to residual vibration (for example, JP-A-2004-276544).

However, in the method for detecting residual vibration, a first period, in which vibration is applied to ink, and a second period, in which vibration of ink is detected as residual vibration, are necessary. In normal printing, vibration may be applied such that ink is discharged from a nozzle, and thus the second period for detecting residual vibration is not necessary. In contrast, the line printer uses a line head and performs printing by transporting a recording sheet. Therefore, if the method for detecting residual vibration is applied to the line printer, it is necessary to make a recording sheet transport speed be slow, and thus there is a problem in that the amount of printing per unit time is reduced, compared to the method for analyzing image data acquired by imaging ink discharge.

SUMMARY

An advantage of some aspects of the invention is to inspect a liquid discharge state using residual vibration while preventing the amount of printing per unit time from being reduced in a line printer.

According to an aspect of the invention, there is provided a liquid discharge apparatus including: a nozzle that discharges liquid; a pressure chamber that communicates with the nozzle; a piezoelectric element that is provided to correspond to the pressure chamber and to discharge liquid; a pulse generation unit that generates a drive pulse to discharge liquid from the nozzle and an inspection pulse to inspect a liquid discharge state; and a residual vibration detection unit that detects change in an electromotive force of the piezoelectric element in accordance with residual vibration in the pressure chamber, which occurs after the inspection pulse is applied to the piezoelectric element. The drive pulse is caused to be applied to the piezoelectric element and the inspection pulse is caused not to be applied to the piezoelectric element at a first printing speed, the drive pulse and the inspection pulse are caused to be applied to the piezoelectric element at a second printing speed, and the second printing speed is slower than the first printing speed.

According to the aspect, since the inspection pulse is caused not to be applied to the piezoelectric element and the drive pulse is caused to be applied to the piezoelectric element at the first printing speed, it is possible to increase the amount of printing per unit time, compared to a case in which the inspection pulse is included to be applied. In addition, although the second printing speed is slower than the first printing speed, it is possible to apply the inspection pulse in addition to the drive pulse. Therefore, it is possible to inspect the liquid discharge state when the printing is being performed. In addition, since residual vibration is used for inspection, it is possible to detect a symptom of dot omission before the dot omission occurs. Meanwhile, the pulse means a waveform of a signal in a predetermined period and there is a case in which the pulse includes a part where a level of the signal is uniform.

The line printer according to the aspect may further include a printing speed control unit that changes a transport speed without stopping transporting of a recording medium when the printing speed is changed from the first printing speed to the second printing speed. According to the aspect, since the printing speed is changed without stopping transporting of the recording medium, it is possible to prevent throughput from being reduced. Meanwhile, when changing from the first printing speed to the second printing speed, it is preferable to decrease the printing speed in a monotonic manner. In addition, when the printing speed returns from the second printing speed to the first printing speed, it is preferable to change the printing speed without stopping transporting of the recording medium. Further, when the printing speed returns from the second printing speed to the first printing speed, it is preferable to increase the printing speed in the monotonic manner.

In the line printer according to the aspect, a total discharge amount of liquid which is discharged from the nozzle per unit time may be greater at the first printing speed than at the second printing speed. According to the aspect, it is possible to improve the throughput at the first printing speed and to inspect the ink discharge state at the second printing speed.

In the line printer according to the aspect, the number of times that liquid, which is discharged from the nozzle per unit time, is discharged may be greater at the first printing speed than at the second printing speed. The inspection pulse includes a first period in which vibration is applied to ink and a second period in which residual vibration of ink is detected. Therefore, at the second printing speed in which the inspection pulse is caused to be applied, the number of times of discharge per unit time is decreased but it is possible to inspect the ink discharge state.

In the line printer according to the aspect, a waveform which causes ink not to be discharged may be used as the inspection pulse when a dot is not recorded at the second printing speed, and a waveform which causes ink to be discharged may be used as the inspection pulse when a dot is recorded.

When the dot is not recorded, it is necessary to use the waveform, which causes ink not to be discharged, as the inspection pulse. However, if the waveform, which causes ink to be discharged, is used as the inspection pulse when the dot is recorded, normally, it is possible to increase the amount of printing per unit time, compared to a case in which the waveform, which causes ink not to be discharged, is used as the inspection pulse.

Subsequently, according to another aspect of the invention, there is provided a method for controlling a line printer including: a nozzle that discharges liquid; a pressure chamber that communicates with the nozzle; a piezoelectric element that is provided to correspond to the pressure chamber and to discharge liquid; a pulse generation unit that generates a drive pulse to discharge liquid from the nozzle and an inspection pulse to inspect a liquid discharge state; and a residual vibration detection unit that detects change in an electromotive force of the piezoelectric element in accordance with residual vibration in the pressure chamber, which occurs after the inspection pulse is applied to the piezoelectric element, the method including: causing the drive pulse to be applied to the piezoelectric element and causing the inspection pulse not to be applied to the piezoelectric element at a first printing speed; causing the drive pulse and the inspection pulse to be applied to the piezoelectric element at a second printing speed; and causing the second printing speed to be slower than the first printing speed. According to the aspect, the inspection pulse may not be applied to the piezoelectric element at the first printing speed but the drive pulse can be applied to the piezoelectric element. Therefore, it is possible to increase the amount of printing per unit time, compared to the case in which the inspection pulse is included to be applied. In addition, although the second printing speed is slower than the first printing speed, it is possible to apply the inspection pulse in addition to the drive pulse. Therefore, it is possible to inspect the liquid discharge state when the printing is being performed.

BRIEF DESCRIPTION OF THE DRAWINGS

The invention will be described with reference to the accompanying drawings, wherein like numbers reference like elements.

FIG. 17A is an explanatory view illustrating the decoded content of a decoder in the first mode, and FIG. 17B is an explanatory view illustrating the decoded content of the decoder in the second mode.

FIG. 28 is an explanatory view illustrating the generation of a determination result signal in a determination unit.

FIG. 29 is a waveform chart illustrating the waveform of an inspection pulse according to a modification example.

FIG. 30 is a waveform chart illustrating a waveform of the inspection pulse according to the modification example.

DESCRIPTION OF EXEMPLARY EMBODIMENTS

Hereinafter, an embodiment of the invention will be described with reference to the accompanying drawings. However, in each drawing, a dimension or a scale of each unit is appropriately made to be different from an actual dimension or a scale. In addition, since the embodiment which will be described below is a preferable detailed example of the invention, the embodiment is provided with various limitations which are technically preferable. However, the scope of the invention is not limited to the embodiment unless the invention is particularly limited in the description below.

A. Embodiment

In this embodiment, an ink jet type line printer, which discharges ink (an example of "liquid") and forms an image on a recording sheet P (an example of a "recording medium"), will be described as an example of a printing apparatus.

Figure 1:
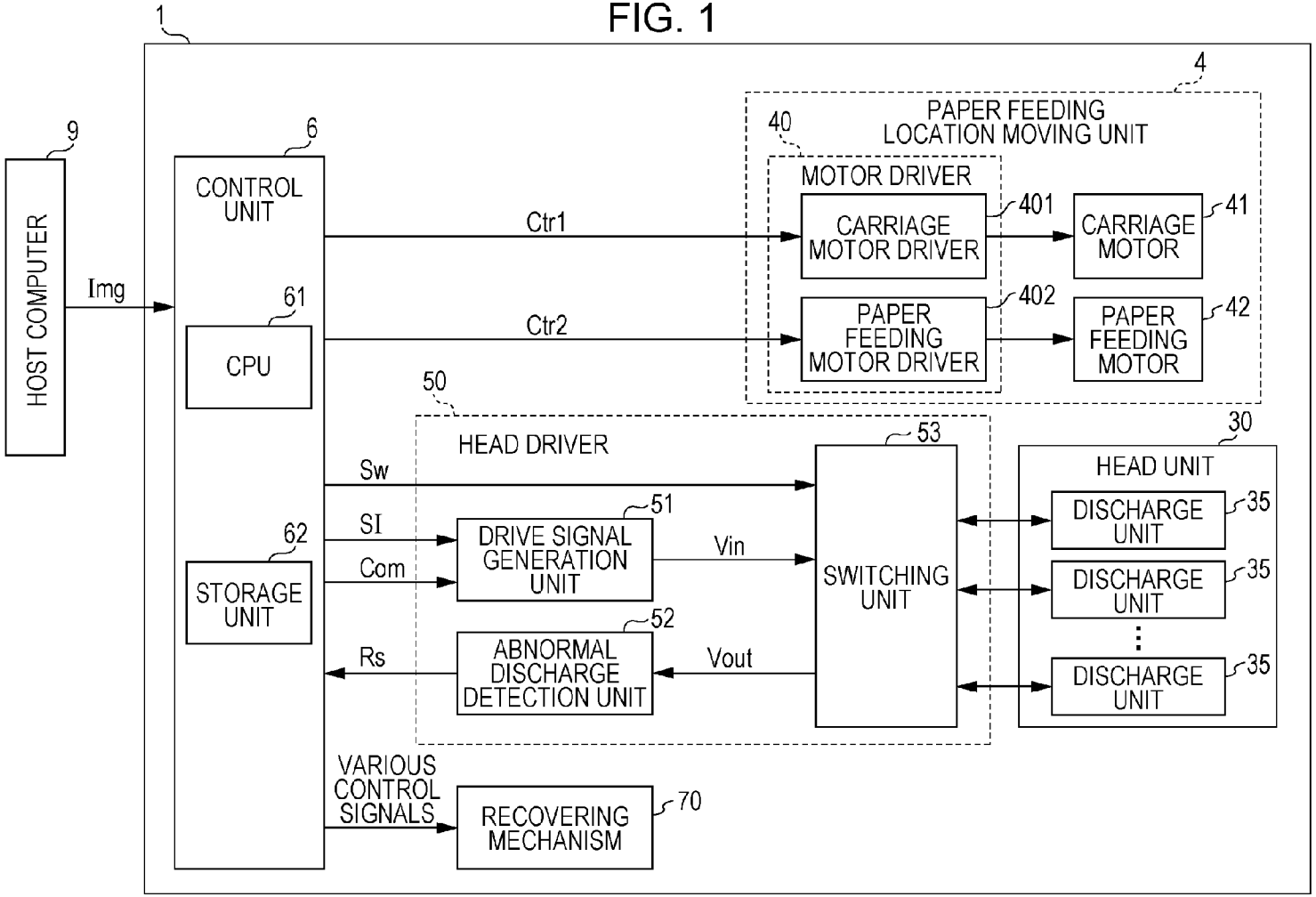
FIG. 1 is a block diagram illustrating the configuration of an ink jet printer according to an embodiment of the invention.

FIG. 1 is a functional block diagram illustrating the configuration of an ink jet printer 1 according to the embodiment. As shown in the drawing, the ink jet printer 1 includes a head unit 30 which includes M (M is a natural number which is equal to or greater than 2) discharge units 35 which are capable of discharging ink charged therein, a head driver 50 which drives the head unit 30, a paper feeding location moving unit 4 (an example of a "relative position movement unit") which moves the relative position of the head unit 30 with regard to the recording sheet P, and a recovering mechanism 70 which performs a recovery process to recover a discharge state of the discharge unit 35 to a normal state when abnormal discharge is detected in the discharge unit 35.

In addition, the ink jet printer 1 includes a control unit 6 which controls the execution of various processes, such as a printing process to form an image on the recording sheet P, an abnormal discharge detection process to detect abnormal discharge of the discharge unit 35, and the recovery process to normally recover the discharge state of the discharge unit 35, by controlling operations of the paper feeding location moving unit 4, the head driver 50, and the recovering mechanism 70 based on image data Img which is supplied from a host computer 9, such as personal computer or a digital camera.

The control unit 6 includes a CPU 61 and a storage unit 62. The storage unit 62 includes an Electrically Erasable Programmable Read-Only Memory (EEPROM) which is one kind of a nonvolatile semiconductor memory for storing the image data Img, supplied from the host computer 9 through an interface unit which is not shown in the drawing, in a data storage area. In addition, the storage unit 62 includes a Random Access Memory (RAM) for temporarily storing data, which is necessary when a printing process for information about the shape of the recording sheet P or the like is executed, and abnormal discharge detection result data, which shows results acquired by performing the abnormal discharge detection process, or for temporarily developing a control program to execute various processes, such as the printing process. In addition, the storage unit 62 includes a PROM which is a nonvolatile semiconductor memory for storing a control program that controls each of the units of the ink jet printer 1.

The CPU 61 controls the execution of various processes, such as the printing process, the abnormal discharge detection process, and the recovery process. More specifically, the CPU 61 stores the image data Img, which is supplied from the host computer 9, in the storage unit 62. In addition, the CPU 61 generates various signals, such as driver control signals Ctr1 and Ctr2 for controlling the drive of the paper feeding location moving unit 4, a printing signal SI for controlling the drive of the head driver 50, a switching control signal Sw, and a drive waveform signal Com, and various control signals for controlling the drive of the recovering mechanism 70 based on various data, such as the image data Img, which is stored in the storage unit 62, and supplies the signals to each of the units of the ink jet printer 1. Therefore, the CPU 61 controls operations of the paper feeding location moving unit 4, the head driver 50, and the recovering mechanism 70, and controls the execution of various processes such as the printing process, the abnormal discharge detection process, and the recovery process. Meanwhile, each of the components of the control unit 6 is electrically connected to the others through a bus which is not shown in the drawing.

The head driver 50 includes a drive signal generation unit 51, an abnormal discharge detection unit 52, and a switching unit 53.

The drive signal generation unit 51 generates a drive signal Vin to drive the discharge unit 35, which is included in the head unit 30, based on the printing signal SI and the drive waveform signal Com which are supplied from the control unit 6. Meanwhile, although details will be described later, the drive waveform signal Com includes three signals, that is, drive waveform signals Com-A, Com-B, and Com-C in the embodiment.

In addition, the printing signal SI and the drive waveform signal Com are called a "printing control signal". That is, the drive signal generation unit 51 generates the drive signal Vin based on the printing control signal.

The abnormal discharge detection unit 52 detects change in pressure of the inside of the discharge unit 35 due to the vibration of ink inside the discharge unit 35, which is generated after the discharge unit 35 is driven based on the drive signal Vin, as a residual vibration signal Vout, determines whether or not abnormal discharge occurs in the discharge unit 35 and the discharge state of ink in the discharge unit 35 based on the residual vibration signal Vout, and outputs a result of the determination as a determination result signal Rs.

The switching unit 53 causes each discharge unit 35 to be connected to the drive signal generation unit 51 or the abnormal discharge detection unit 52 based on the switching control signal Sw which is supplied from the control unit 6.

The paper feeding location moving unit 4 includes a carriage motor 41 for moving the head unit 30 (more accurately, for moving a carriage 32 on which the head unit 30 is mounted), a carriage motor driver 401 for driving the carriage motor 41, a paper feeding motor 42 for transporting the recording sheet P, and a paper feeding motor driver 402 for driving the paper feeding motor 42. Meanwhile, the carriage motor driver 401 and the paper feeding motor driver 402 are called a motor driver 40.

The ink jet printer 1 according to the embodiment operates in a first mode in which printing is performed at a first printing speed and a second mode in which printing is performed at a second printing speed. In the first mode, printing is performed but the discharge state of ink is not inspected. In the second mode, the discharge state of ink is inspected during the printing. In addition, the first printing speed is more rapid than the second printing speed.

Figure 2:
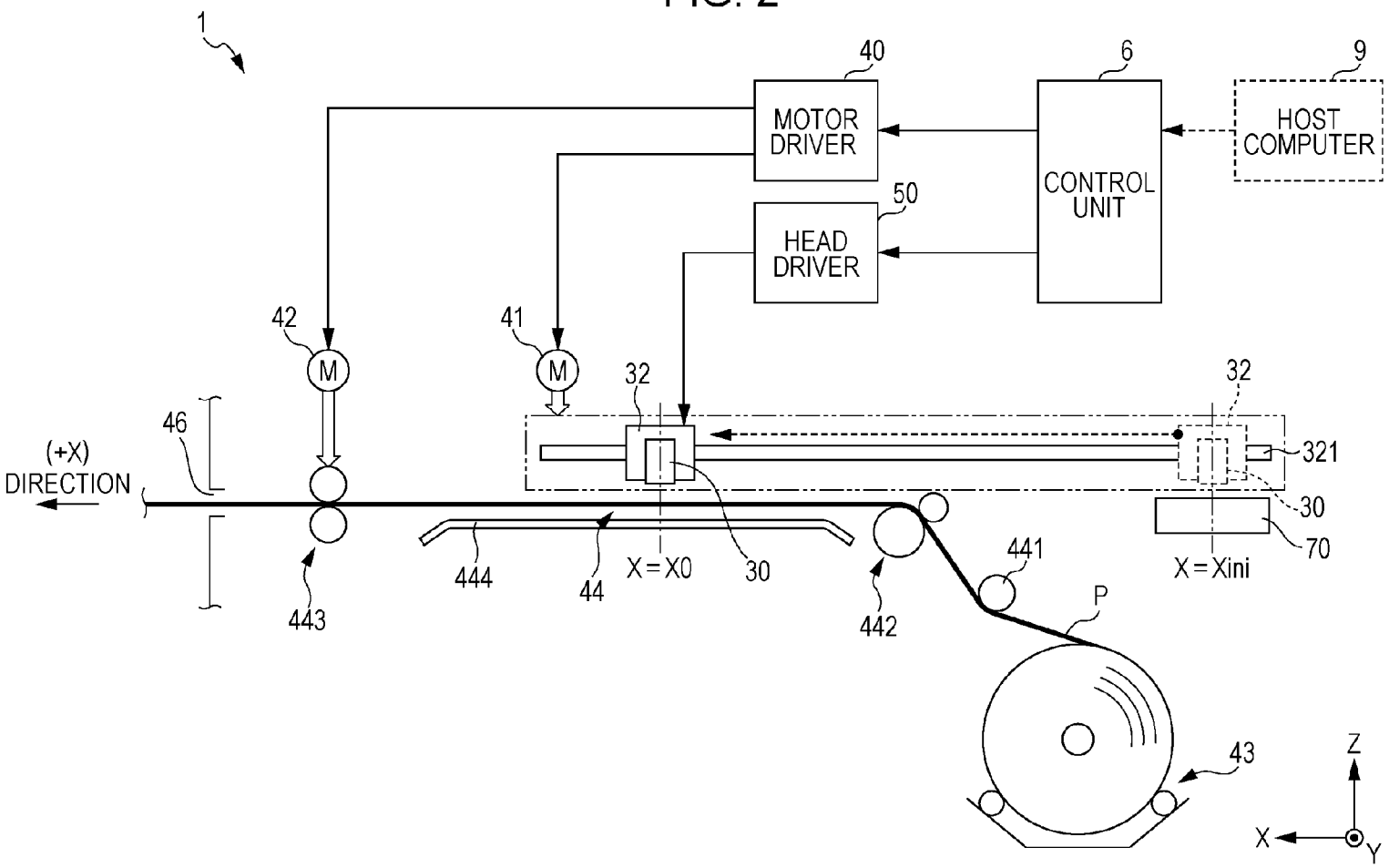
FIG. 2 is a diagram illustrating the schematic configuration of the ink jet printer.

FIG. 2 is a schematic diagram illustrating the configuration of the ink jet printer 1. As shown in the drawing, the ink jet printer 1 includes a rolled paper storage unit 43 which is configured to wind up the recording sheet P in a rolled shape in order to store rolled paper, and the recording sheet P is stored in the rolled paper storage unit 43 and then sent out therefrom. Further, the recording sheet P is transported in an X-axis direction along a transporting path 44, which is defined by a guide roller 441, a pair of driven side paper feeding rollers 442, a pair of driving side paper feeding rollers 443, a platen 444, and the like, by a pair of driving side paper feeding rollers 443 which is rotatably driven by the paper feeding motor 42, and is ejected from a paper outlet 46. The paper feeding motor 42 transports the recording sheet P at a speed, which is more rapid than that in the second mode, in the first mode. When the printing speed is changed from the first printing speed to the second printing speed, the control unit 6 functions as a printing speed control unit which changes the transport speed without stopping transporting of the recording sheet P.

The carriage 32, on which the head unit 30 is mounted, is arranged on a side opposite to the platen 444 while interposing the transporting path 44 of the recording sheet P, that is, in a (+Z) direction when viewed from the platen 444. The carriage 32 is capable of moving back and forth linearly within a predetermined range along an X-axis direction using a head unit movement mechanism which includes, for example, a carriage guide shaft 321, such as ball screws and ball splines extended in the X-axis direction, and a carriage motor 41.

In a state in which the head unit 30 is moved to a printing position (X=X0), the control unit 6 performs the printing process by transporting the recording sheet P in the X-axis direction and, at the same time, discharging ink from the plurality of discharge units 35, which are included in the head unit 30, to an area in which a label Lb of the recording sheet P is arranged based on the image data Img.

In addition, when abnormal discharge is found in the discharge units 35, the control unit 6 performs a recovery process by moving the head unit 30 to an initial position (X=Xini) which faces the recovering mechanism 70.

In addition, although not shown in FIG. 2, the ink jet printer 1 includes four ink cartridges which are charged with ink. More specifically, the four ink cartridges are provided to correspond one-to-one to four colored inks, that is, yellow, cyan, magenta, and black, and are mounted on the carriage 32.

Each of M discharge units 35 receives the supply of ink from any one of the four ink cartridges. Therefore, it is possible to discharge any one of the four color inks from each of the discharge units 35, and thus full color printing is possible.

Meanwhile, the ink cartridge may be installed in another place of the ink jet printer 1 instead of being mounted on the carriage 32. In addition, the ink jet printer 1 may further include an ink cartridge charged with inks of colors which are different from the four colors, or may include only an ink cartridge corresponding to a part of the four colors (for example, only include an ink cartridge corresponding to black).

In addition, as shown in FIG. 2, the head unit 30 includes a width which is equal to or greater than a width of the recording sheet P in an Y-axis direction in a planar view. As described above, the head unit 30 includes M discharge units 35, and each of the M discharge units 35 includes one nozzle N. That is, M nozzles N (N[1], N[2], . . . , and N[M]) are provided in the head unit 30.

The head unit 30 shown in the drawing includes four nozzle columns which include a plurality of nozzles N (in the drawing, 22 nozzles N) which are extended in the width direction (Y-axis direction). Further, in the four nozzle columns, yellow (Y) ink is discharged from each of the nozzles N which are included in a first nozzle column, magenta (M) ink is discharged from each of the nozzles N which are included in a second nozzle column, cyan (C) ink is discharged from each of the nozzles N which are included in a third nozzle column, and black (K) ink is discharged from each of the nozzles N which are included in a fourth nozzle column.

Subsequently, the configurations of the head unit 30 and the discharge units 35 included in the head unit 30 will be described with reference to FIGS. 3 and 4.

Figure 3:
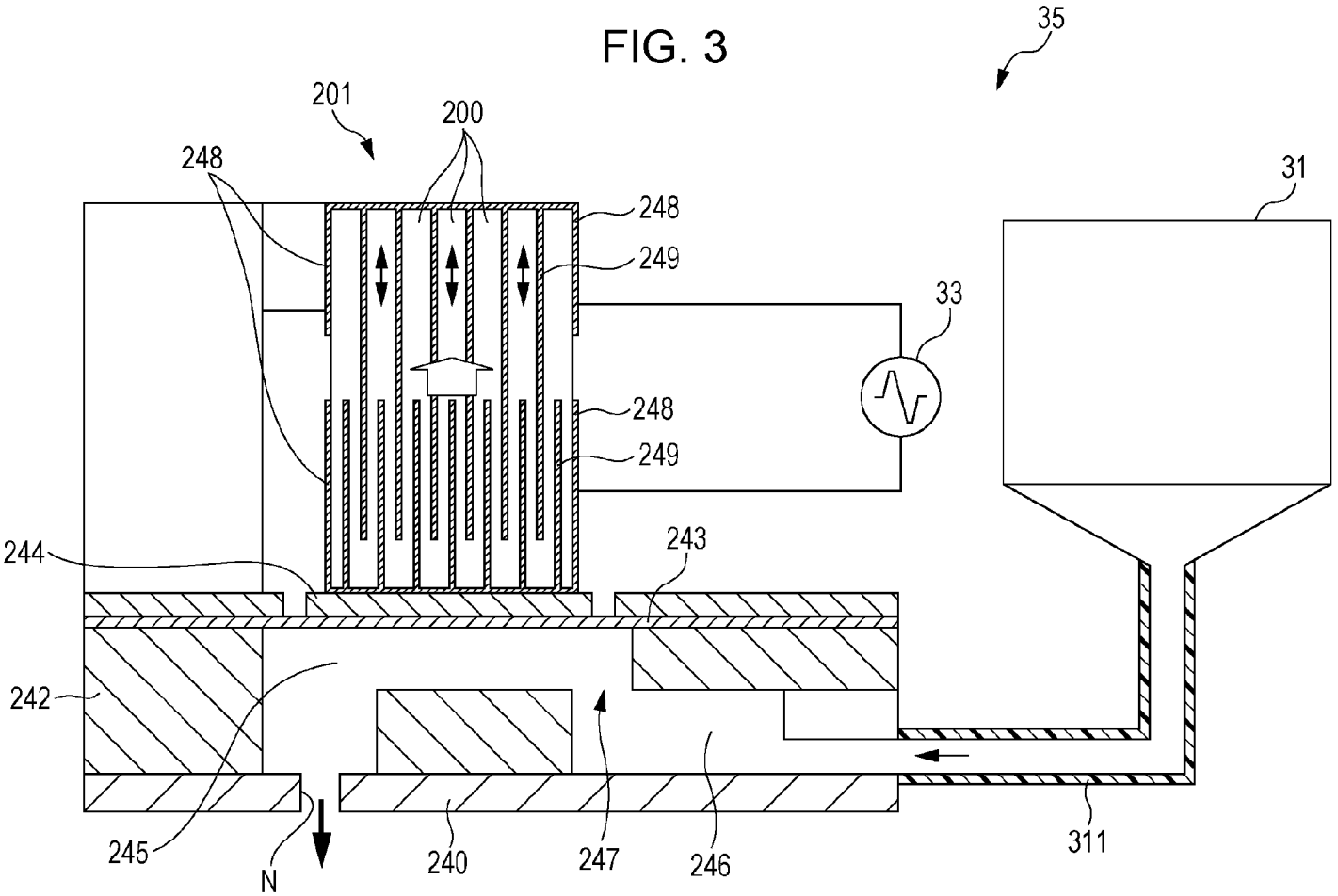
FIG. 3 is a schematic sectional diagram illustrating an example of a head unit according to the embodiment.

FIG. 3 is a schematic sectional diagram illustrating each of the discharge units 35 included in the head unit 30. The discharge unit 35 shown in FIG. 3 is configured such that ink (liquid) within a cavity 245 is discharged from the nozzle N when piezoelectric elements 200 are driven. The discharge unit 35 includes a nozzle plate 240 in which the nozzle N is formed, a cavity plate 242, a vibration plate 243, and a laminated piezoelectric element 201 which is formed by laminating the plurality of piezoelectric elements 200.

The cavity plate 242 is formed to have a predetermined shape (shape in which a recession is formed), and thus the cavity 245 and a reservoir 246 are formed. The cavity 245 communicates with the reservoir 246 through an ink support port 247. In addition, the reservoir 246 communicates with the ink cartridge through an ink supply tube 311.

The lower end of the laminated piezoelectric element 201 in FIG. 3 is bonded to the vibration plate 243 through an intermediate layer 244. In the laminated piezoelectric element 201, a plurality of external electrodes 248 and internal electrodes 249 are bonded to each other. That is, the external electrodes 248 are bonded to the external surface of the laminated piezoelectric element 201, and the internal electrodes 249 are installed between each of the piezoelectric elements 200 (or inside each of the piezoelectric elements) which form the laminated piezoelectric element 201. In this case, arrangement is made such that some of the external electrodes 248 and the internal electrodes 249 are alternately superimposed in the thickness direction of the piezoelectric elements 200.

Further, when a drive voltage waveform is applied between the external electrodes 248 and the internal electrodes 249 by the drive signal generation unit 33, the laminated piezoelectric element 201 deforms and vibrates as shown using arrows in FIG. 3 (expands and contracts in a vertical direction in FIG. 3), and the vibration plate 243 vibrates due to the vibration. The capacity of the cavity 245 (pressure in the cavity) changes due to the vibration of the vibration plate 243, and ink (liquid) which is charged in the cavity 245 is discharged from the nozzle N as liquid.

The amount of liquid, which is reduced in the cavity 245 due to the discharge of liquid, is replenished in such a way that ink is supplied from the reservoir 246. In addition, ink is supplied to the reservoir 246 from the ink cartridge through the ink supply tube 311.

Figure 4:
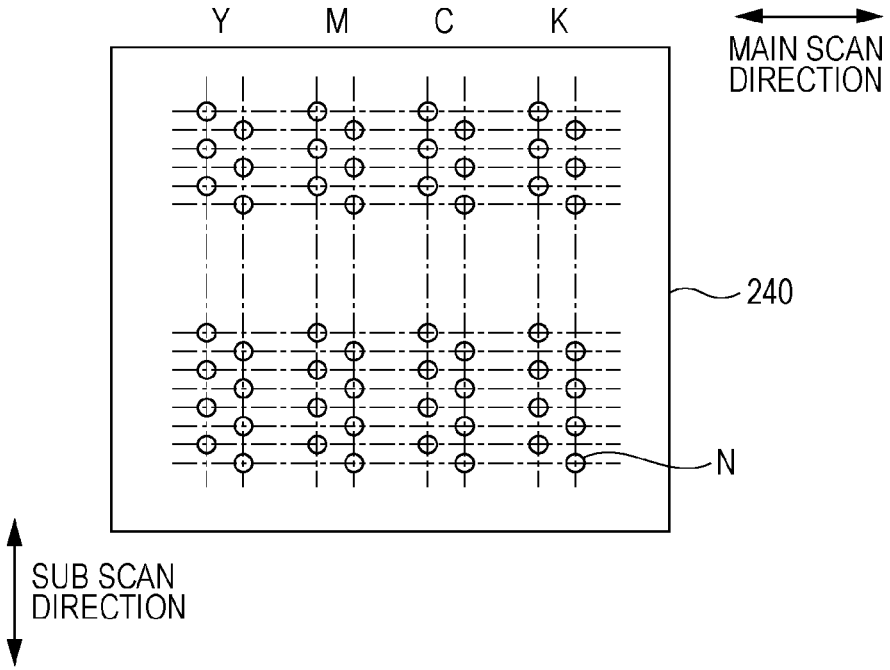
FIG. 4 is a plane view illustrating the arrangement pattern of nozzles.

Meanwhile, the arrangement pattern of the nozzles N which are formed in the nozzle plate 240 shown in FIG. 3 is, for example, arrangement in which stages are shifted as a nozzle arrangement pattern shown in FIG. 4. In addition, a pitch between the nozzles N may be appropriately set according to a printing resolution (dpi: dot per inch). Meanwhile, FIG. 4 shows a pattern of the arrangement of the nozzles N when four color inks (ink cartridge) are applied.

Figure 5:
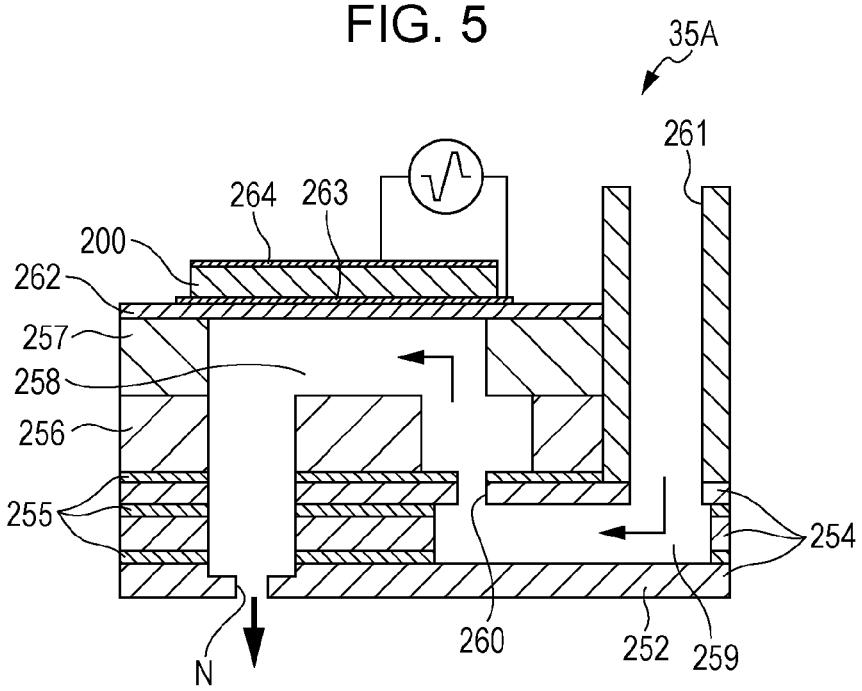
FIG. 5 is a schematic sectional diagram illustrating a configuration which shows another example of the head unit.

Subsequently, another example of the discharge unit 35 will be described. A discharge unit 35A shown in FIG. 5 is configured such that a vibration plate 262 vibrates when the piezoelectric elements 200 are driven, and ink (liquid) within a cavity 258 is discharged from the nozzle N. A metallic plate 254, which is formed of stainless steel, is bonded to the nozzle plate 252, in which the nozzle (hole) 253 is formed and which is formed of stainless steel, through an adhesive film 255. Further, a metallic plate 254, which is formed of the same stainless steel, is bonded to the metallic plate 254 through the adhesive film 255. Further, a communication hole forming plate 256 and a cavity plate 257 are sequentially bonded there on.

Each of the nozzle plate 252, the metallic plate 254, the adhesive film 255, the communication hole forming plate 256, and the cavity plate 257 is formed to have a predetermined shape (shape in which a recession is formed), and the cavity 258 and the reservoir 259 are formed by stacking the nozzle plate 252, the metallic plate 254, the adhesive film 255, the communication hole forming plate 256, and the cavity plate 257. The cavity 258 communicates with the reservoir 259 through an ink support port 260. In addition, the reservoir 259 communicates with an ink inlet 261.

The vibration plate 262 is installed in the opening section on the upper surface of the cavity plate 257, and the piezoelectric elements 200 are bonded to the vibration plate 262 through lower electrode 263. In addition, upper electrodes 264 are bonded on a side opposite to the lower electrodes 263 piezoelectric elements 200. When the drive signal generation unit 33 applies (supplies) a drive voltage waveform between the upper electrodes 264 and the lower electrodes 263, the piezoelectric elements 200 vibrate, and thus the vibration plate 262 which is bonded thereto vibrates. The capacity of the cavity 258 (pressure in the cavity) changes due to vibration of the vibration plate 262, and ink (liquid) which is charged in the cavity 258 is discharged from the nozzle N as liquid.

The amount of liquid, which is reduced in the cavity 258 due to the discharge of liquid, is replenished in such a way that ink is supplied from the reservoir 259. In addition, ink is supplied to the reservoir 259 from the ink inlet 261.

Figure 6A:
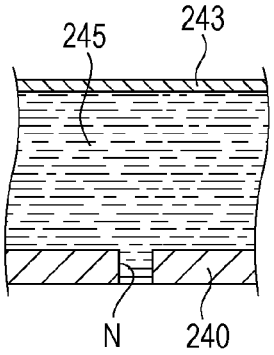
FIGS. 6A to 6C are explanatory views illustrating change in a sectional surface shape of the head unit when a drive signal is supplied.
Figure 6B:
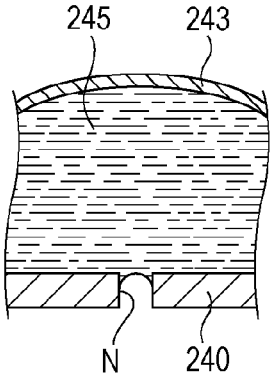
Figure 6C:
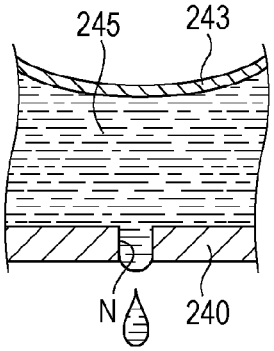

Subsequently, the discharge of ink drops will be described with reference to FIGS. 6A to 6C. If a drive voltage is applied to the piezoelectric elements 200 shown in FIG. 3 (FIG. 5) from the drive signal generation unit 33, a Coulomb force is generated between the electrodes, the vibration plate 243 (262) is deformed to the upper direction in FIG. 3 (FIG. 5) with regard to an initial state show in FIG. 6A, and thus the capacity of the cavity 245 (258) is enlarged as shown in FIG. 6B. In this state, if the drive voltage is changed under the control of the drive signal generation unit 33, the vibration plate 243 (262) is recovered due to the elastic restoring force thereof, moves to the lower direction over the position of the vibration plate 243 (262) in the initial state, and thus the capacity of the cavity 245 (258) is rapidly reduced as shown in FIG. 6C. At this time, some of ink (liquid material), which fills the cavity 245 (258), is discharged as ink drops from the nozzle N, which communicates with the cavity 245 (258), due to compression pressure which is generated in the cavity 245 (258).

After a series of ink discharge operations are terminated, the vibration plate 243 of each cavity 245 performs attenuation vibration before a subsequent ink discharge operation starts. Hereinafter, the attenuation vibration is called residual vibration. It is assumed that the residual vibration of the vibration plate 243 has a unique vibration frequency which is determined based on the shape of the nozzle N or the ink support port 247, acoustic resistance r based on ink viscosity, inertance m based on ink weight in a flow path, and compliance Cm of the vibration plate 243.

A calculation module of the residual vibration of the vibration plate 243 will be described based on the assumption.

Figure 7:
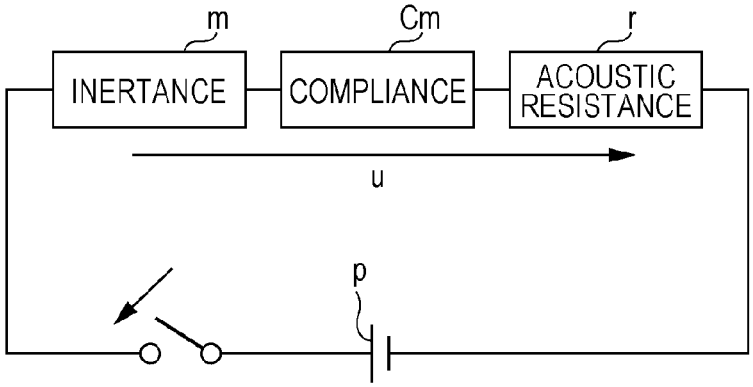
FIG. 7 is a circuit diagram illustrating a single vibration model which shows residual vibration in a discharge unit.

FIG. 7 is a circuit diagram illustrating a calculation module of the residual vibration of a simple harmonic vibration which is used to assume the residual vibration of the vibration plate 243. In this way, the calculation module of the residual vibration of the vibration plate 243 is expressed using an acoustic pressure p, the above-described inertance m, the compliance Cm, and the acoustic resistance r. Further, if a step response, acquired when the acoustic pressure p is applied to the circuit in FIG. 7, is calculated with regard to a volume speed u, expressions below are acquired.

$$u=\{p/(\omega\cdot m)\}e^{-\omega t}\cdot\sin(\omega t)$$

$$\omega=\{1/(m\cdot Cm)-\alpha^2\}^{1/2}$$

$$\alpha=r/(2m)$$

Figure 8:
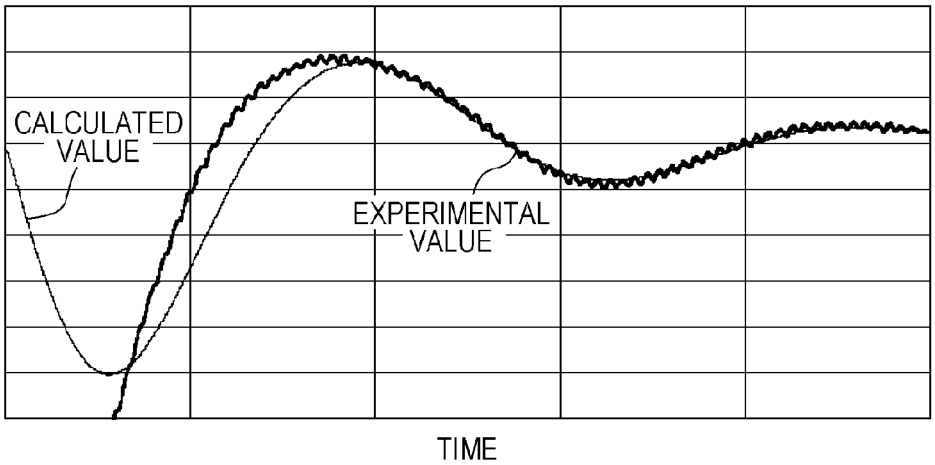
FIG. 8 is a graph illustrating a relationship between an experimental value and a calculated value of the residual vibration when the discharge state of the discharge unit is normal.

A calculation result, which is acquired from the expressions, is compared with an experimental result, which is acquired through an additionally performed experiment of the residual vibration of the vibration plate 243 after the ink drops are discharged. FIG. 8 is a graph illustrating the relationship between an experimental value and a calculated value of the residual vibration of the vibration plate 243. As understood from the graph shown in FIG. 8, the two waveforms of the experimental value and the calculated value are almost matched with each other.

Further, although the discharge operation as described above is performed, there is a phenomenon in which ink drops are not normally discharged from the nozzle N, that is, there is a case in which abnormal liquid discharge is generated in the discharge unit 35. A reason that the abnormal discharge is generated includes (1) a bubble mixed into the cavity 245, (2) dry or thickened (stuck) ink in the vicinity of the nozzle N, (3) attachment of paper powder in the vicinity of the outlet of the nozzle N, and the like.

If the abnormal discharge is generated, generally, liquid is not discharged from the nozzle N, that is, a non-liquid discharge phenomenon occurs as a result. In this case, the omission of a dot of a pixel is generated in an image which is printed on the recording sheet P. In addition, even when liquid is discharged from the nozzle N, the amount of liquid is small or the flight direction (trajectory) of liquid is deviated, and thus liquid does not land properly in the case of the abnormal discharge. Therefore, the omission of dots of pixels also appears. For these reasons, in the description below, there is a case in which the abnormal liquid discharge is simply called "dot omission".

Hereinafter, based on a result of comparison shown in FIG. 8, a value of at least one side of the acoustic resistance r and the inertance m is adjusted such that the calculated value and the experimental value of the residual vibration of the vibration plate 243 are matched (almost matched) for each reason for the dot omission (abnormal discharge) phenomenon (non-liquid discharge phenomenon) which is generated in the discharge unit 35 when the printing process is performed.

Figure 9:
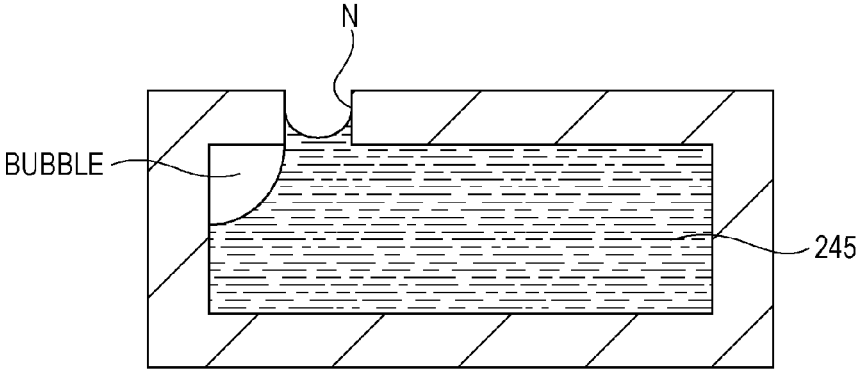
FIG. 9 is an explanatory view illustrating the state of the discharge unit when a bubble is mixed into the inside of a cavity.

First, (1) a bubble mixed into the cavity 245, which is one reason for the dot omission, will be examined. FIG. 9 is a conceptual diagram illustrating the vicinity of the nozzle N when a bubble is mixed into the inside of the cavity 245. As shown in FIG. 9, it is assumed that the generated bubble is generated and attached on the wall surface of the cavity 245.

As above, when a bubble is mixed into the cavity 245, the total weight of ink which fills the cavity 245 is reduced, and thus it is conceivable that the inertance m decreases. In addition, when a bubble is attached to the vicinity of the nozzle N as shown in FIG. 9, a state in which the diameter of the nozzle N becomes as great as the diameter of the bubble is generated, and thus it is conceivable that the acoustic resistance r decreases.

Figure 10:
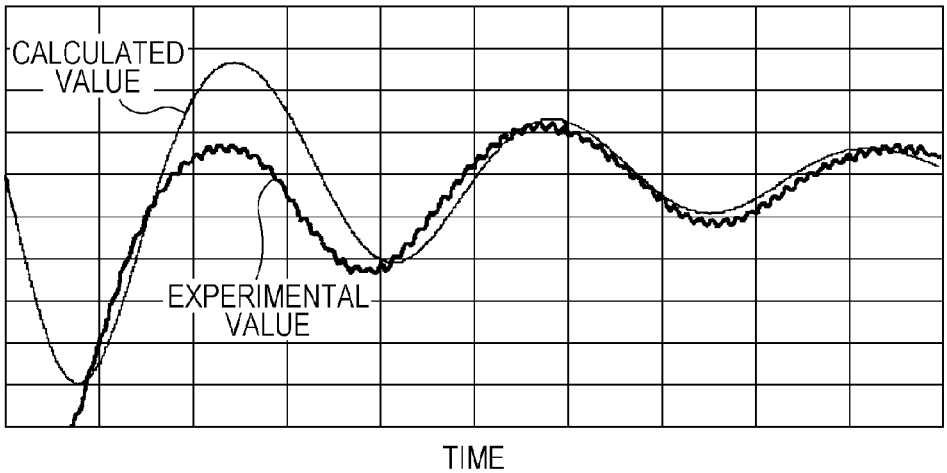
FIG. 10 is a graph illustrating the relationship between the experimental value and the calculated value of the residual vibration in a state in which it is difficult to discharge ink due to a bubble which is mixed into the inside of the cavity.

Therefore, in the case of FIG. 8 in which ink is normally discharged, both the acoustic resistance r and the inertance m are set to small values and the values are matched with the experimental values of the residual vibration when a bubble is mixed, and thus a result (graph) as in FIG. 10 is acquired. As understood from the graphs in FIGS. 8 and 10, when a bubble is mixed into the cavity 245, a characteristic residual vibration waveform, in which a frequency is high compared to the case of normal discharge, is acquired. Meanwhile, it is possible to recognize that an attenuation rate of the amplitude of the residual vibration is small due to the decrease in the acoustic resistance r and the amplitude of the residual vibration is slowly lowered.

Figure 11:
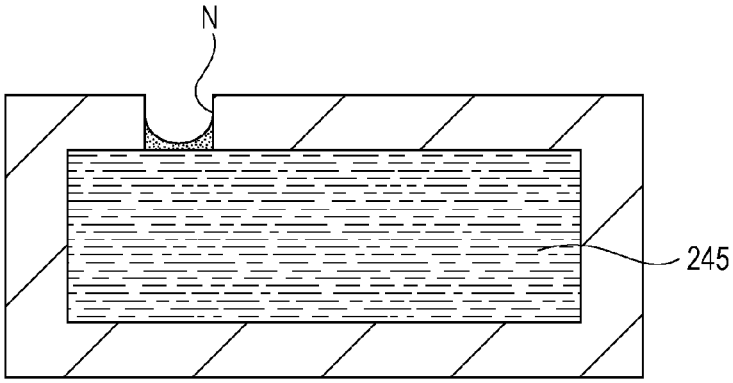
FIG. 11 is an explanatory view illustrating a state of the discharge unit when ink is stuck in the vicinity of a nozzle.

Subsequently, (2) dry (stuck or thickened) ink in the vicinity of the nozzle N, which is another reason for the dot omission, will be examined. FIG. 11 is a conceptual diagram illustrating the vicinity of the nozzle N when ink, which is in the vicinity of the nozzle N in FIG. 4, dries and is stuck. As shown in FIG. 11, when ink in the vicinity of the nozzle N is dry and stuck, ink in the cavity 245 is in a state which is closed in the cavity 245. As above, when ink in the vicinity of the nozzle N is dry and thickened, it is conceivable that the acoustic resistance r increases.

Figure 12:
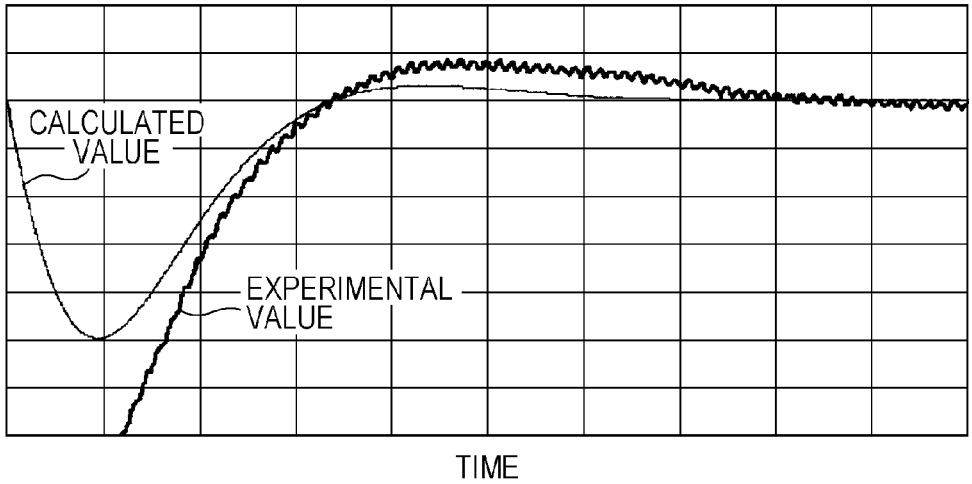
FIG. 12 is a graph illustrating the relationship between the experimental value and the calculated value of the residual vibration in a state in which it is difficult to discharge ink due to ink stuck in the vicinity of the nozzle.

Therefore, with regard to the case in FIG. 8 in which ink is normally discharged, the acoustic resistance r is set to a large value and the value is matched with the experimental values of the residual vibration when ink in the vicinity of the nozzle N is dry and stuck (thickened), and thus a result (graph) as in FIG. 12 is acquired. Meanwhile, the experimental value shown in FIG. 12 is acquired by leaving the discharge unit 35 in a state in which a cap, which is not shown in the drawing, is not mounted for a few days and by measuring the residual vibration of the vibration plate 243 in a state in which it is difficult to discharge ink (ink is stuck) because ink in the vicinity of the nozzle N is dry and thickened. As understood from the graphs in FIGS. 8 and 12, when ink in the vicinity of the nozzle N is dry and stuck, a characteristic residual vibration waveform, in which frequency is extremely low and residual vibration is overdamped compared to the case of normal discharge, is acquired. The reason for this is that the vibration plate 243 is gravitated to the lower side in FIG. 4 in order to discharge ink drops, and thus, when the vibration plate 243 moves to the upper side in FIG. 4 after ink enters the cavity 245 from the reservoir 246, it is difficult for the vibration plate 243 to rapidly vibrate (due to overdamping) because there is not an escape route for ink in the cavity 245.

Figure 13:
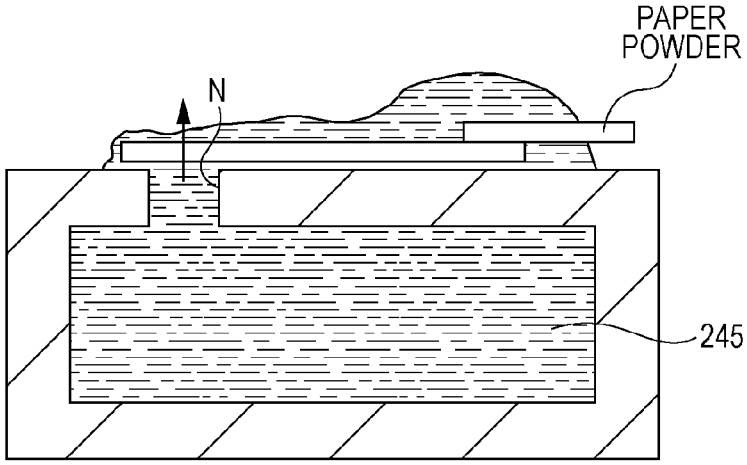
FIG. 13 is an explanatory view illustrating the state of the discharge unit when paper powder is adhered to the vicinity of an outlet of the nozzle.

Subsequently, (3) attachment of paper powder in the vicinity of the outlet of the nozzle N, which is still another reason for the dot omission, will be examined. FIG. 13 is a conceptual diagram illustrating the vicinity of the nozzle N when paper powder is adhered to the vicinity of the outlet of the nozzle N in FIG. 4. As shown in FIG. 13, when paper powder is adhered to the vicinity of the outlet of the nozzle N, ink oozes from the inside of the cavity 245 through paper powder and it is difficult to discharge ink from the nozzle N. As above, when paper powder is adhered to the vicinity of the outlet of the nozzle N and ink oozes from the nozzle N than a normal state, ink inside the cavity 245 and oozing ink increase when viewed from a side of the vibration plate 243, and thus it is conceivable that inertance m increases. In addition, it is conceivable that the acoustic resistance r increases according to the fiber of paper powder which is adhered to the vicinity of the outlet of the nozzle N.

Figure 14:
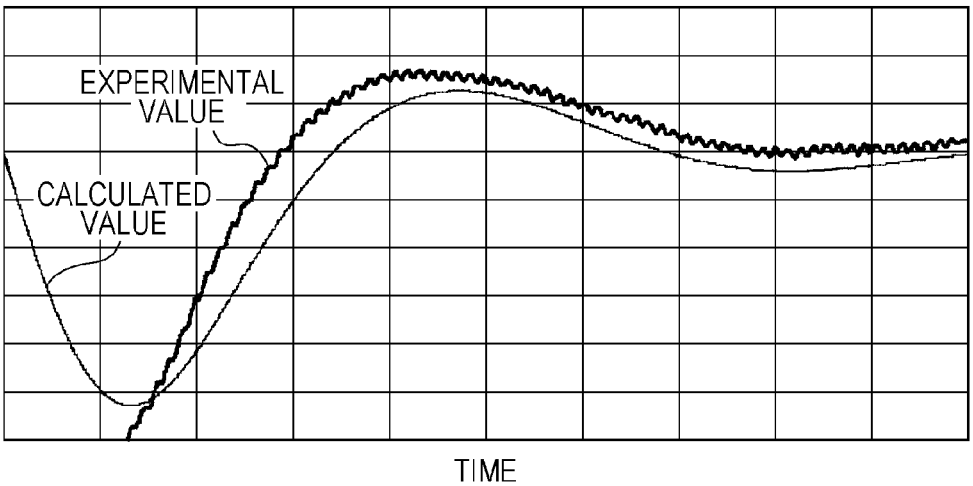
FIG. 14 is a graph illustrating the relationship between the experimental value and the calculated value of the residual vibration in a state in which it is difficult to discharge ink due to paper powder which is stuck in the vicinity of the outlet of the nozzle.

Therefore, in the case of FIG. 8 in which ink is normally discharged, both the inertance m and the acoustic resistance r are set to large values, the values are matched with the experimental values of the residual vibration and acquired when paper powder is adhered to the vicinity of the outlet of the nozzle N, and thus a result (graph) as in FIG. 14 is acquired. As understood from the graphs in FIGS. 8 and 14, when paper powder is adhered to the vicinity of the outlet of the nozzle N, a characteristic residual vibration waveform, in which frequency is low compared to the case of normal discharge, is acquired.

Meanwhile, from the graphs shown in FIGS. 12 and 14, when paper powder is adhered, it is understood that the frequency of the residual vibration is high compared to the case in which ink dries.

Here, the frequency of attenuation vibration is low in both the case in which ink in the vicinity of the nozzle N is dry and thickened and the case in which paper powder is adhered to the vicinity of the outlet of the nozzle N, compared to the case in which ink drops are normally discharged. In order to specify the two reasons of the dot omission (non-ink discharge: abnormal discharge) based on the waveform of the residual vibration of the vibration plate 243, it is possible to perform comparison using, for example, a predetermined threshold in the frequency, the cycle, or the phase of attenuation vibration or it is possible to specify based on the attenuation rate of the change in the cycle or the amplitude of the residual vibration (attenuation vibration). In this manner, it is possible to detect the abnormal discharge of each discharge unit 35 based on the change in the residual vibration of the vibration plate 243, in particular, the change in the frequency thereof acquired when ink drops are discharged from the nozzle N of each discharge unit 35. In addition, it is possible to specify the reason for the abnormal discharge by comparing the frequency of the residual vibration in a certain case with the frequency of the residual vibration in the case of normal discharge.

The ink jet printer 1 according to the embodiment detects the abnormal discharge by analyzing the residual vibration.

Subsequently, the configuration and the operation of the head driver 50 (the drive signal generation unit 51, the abnormal discharge detection unit 52, and the switching unit 53) will be described with reference to FIGS. 15 to 21.

Figure 15:
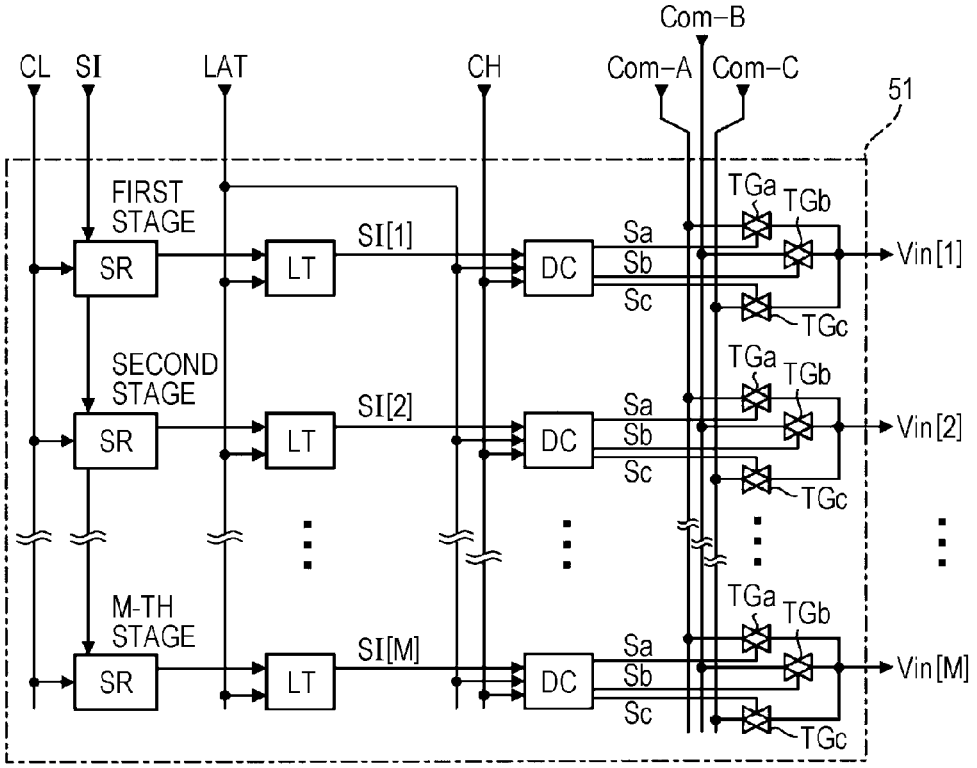
FIG. 15 is a block diagram illustrating a configuration of a drive signal generation unit.

FIG. 15 is a block diagram illustrating the configuration of the drive signal generation unit 51 of the head driver 50. As shown in FIG. 15, the drive signal generation unit 51 includes M sets which each includes a shift register SR, a latch circuit LT, a decoder DC, and transmission gates TGa, TGb and TGc such that the sets correspond one-to-one to the M discharge units 35. Hereinafter, there is a case in which respective components which are included in the M sets are sequentially called a first stage, a second stage, . . . , and an M-th stage from above in the drawing.

Meanwhile, although description will be made in detail later, the abnormal discharge detection unit 52 includes M abnormal discharge detection circuits DT (DT[1], DT[2], . . . , and DT[M]) such that the abnormal discharge detection circuits DT correspond one-to-one to the M discharge units 35.

A clock signal CL, a printing signal SI, a latch signal LAT, a change signal CH, and drive waveform signals Com (Com-A, Com-B, Com-C) are supplied to the drive signal generation unit 51 from the control unit 6.

Here, the printing signal SI is a digital signal for deciding the amount of ink which is discharged from each discharge unit 35 (each nozzle N) when one dot of an image is formed. More specifically, the printing signal SI according to the embodiment is for deciding the amount of ink which is discharged from each discharge unit 35 (each nozzle N) using three bits, that is, a higher bit b1, a medium bit b2, and a lower bit b3, and is serially supplied to the drive signal generation unit 51 from the control unit 6 in synchronization with the clock signal CL.

When the amount of ink which is discharged from each discharge unit 35 is controlled using the printing signal SI, it is possible to express four gray scales, that is, non-recording, a small dot, a medium dot, and a large dot in each dot of the recording sheet P, and it is further possible to generate an inspection drive signal for inspecting an ink discharge state by generating the residual vibration. In the embodiment, a large dot is formed by three times of discharge, a medium dot is formed by two times of discharge, and a small dot is formed by one time discharge.

Each of the shift registers SR holds the printing signal SI at once for every two bits corresponding to each of the discharge units 35. More specifically, the M shift registers SR in the first stage, the second stage, . . . , and the M-th stage, which correspond one-to-one to the M discharge units 35, are connected to each other in a cascade manner, and the printing signal SI is sequentially transmitted to the latter part according to the clock signal CL. Further, at a time point that the printing signal SI is transmitted to all of the M shift registers SR, the clock signal CL stops being supplied, and a state, in which each of the M shift registers SR maintains the three-bit data of the printing signal SI corresponding thereto, is maintained.

The respective M latch circuits LT simultaneously latch the three-bit printing signal SI corresponding to the respective stages which are held in the respective M shift registers SR at a timing at which the latch signal LAT rises. In FIG. 15, SI[1], SI[2], . . . , and SI[M] respectively indicate three-bit printing signals SI which are respectively latched by the latch circuits LT corresponding to the shift registers SR in the first stage, the second stage, . . . , and the M-th stage.

However, a printing operation period which is a period in which the ink jet printer 1 performs printing by forming an image on the recording sheet P includes a plurality of unit operation periods. One unit operation period is a period in which one dot is formed. In the description below, a unit operation period in the first mode in which printing is performed at the first printing speed is called a first unit operation period Tu1, and a unit operation period in the second mode in which printing is performed at the second printing speed is called a second unit operation period Tu2. Further, when both the first unit operation period and the second unit period are not distinguished from each other, they are called a unit operation period Tu.

Further, with regard to each of the M discharge units 35, the control unit 6 allocates the printing process in the first mode and allocates the abnormal discharge detection process and the printing process in the second mode.

Figure 16A:
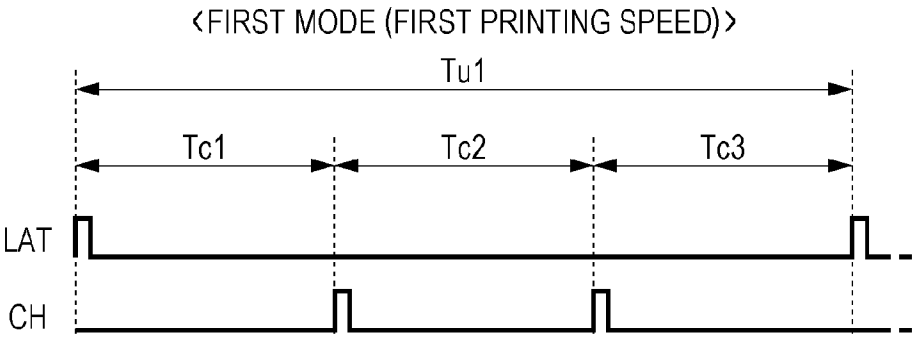
FIG. 16A is a timing chart illustrating a latch signal and a change signal in a first mode.

As shown in FIG. 16A, the first unit operation period Tu1 is a period from when the latch signal LAT enters an active state to when the latch signal LAT enters a subsequent active state, and includes control periods Tc1, Tc2, and Tc3. Further, at a timing at which the control period changes from the control period Tc1 to the control period Tc2 and a timing at which the control period changes from the control period Tc2 to the control period Tc3, a change signal CH enters an active state. In the embodiment, the control periods Tc1, Tc2, and Tc3 include time lengths equivalent with each other.

Figure 16B:
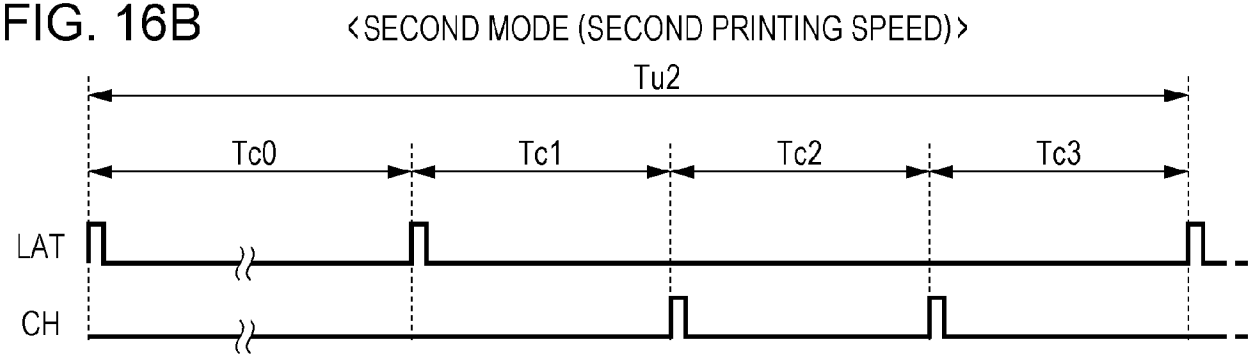
FIG. 16B is a timing chart illustrating a latch signal and a change signal in a second mode.

In contrast, as shown in FIG. 16B, in the second unit operation period Tu2, the latch signal LAT enters an active state two times and the second unit operation period Tu2 includes control periods Tc0, Tc1, Tc2, and Tc3. That is, the second unit operation period Tu2 is acquired by adding the control period Tc0 to the first unit operation period Tu1. Meanwhile, with regard to the control period Tc0, Tc0>Tc1=Tc2=Tc3.

The control unit 6 supplies the printing signal SI to the drive signal generation unit 51 one time in every first unit operation period Tu1, and supplies the printing signal SI two times in every second unit operation period Tu2. In addition, the latch circuits LT latch the printing signals SI[1], SI[2], . . . , and SI[M] in synchronization with the latch signal LAT.

The decoder DC decodes the three-bit printing signal SI which is latched by the latch circuit LT, and outputs selection signals Sa, Sb and Sc in each of the control periods Tc0 to Tc3.

FIG. 17A is an explanatory view (table) illustrating content of decoding performed by the decoder DC in the first unit operation period Tu1. As shown in the drawing, when content shown by a printing signal SI[m] corresponding to an m-th stage (m is a natural value which satisfies $1 \leq m \leq M$) is that, for example, (b1, b2, b3)=(1, 0, 0), the decoder DC in the m-th stage sets the selection signal Sa to a high level H and sets the selection signals Sb and Sc to a low level L in the control period Tc1. In addition, the decoder DC in the m-th stage sets the selection signals Sa and Sc to the low level L and sets the selection signal Sb to the high level H in the control period Tc2. Meanwhile, in the first unit operation period Tu1, there is not a case in which b3 is "1" and the selection signal Sc is normally at the low level L and does not become the high level H.

FIG. 17B is an explanatory view (table) illustrating content of decoding performed by the decoder DC in the second unit operation period Tu2. In the control period Tc0, the content of decoding in the second unit operation period Tu2 is different from the content of decoding in the first unit operation period Tu1. In the control period Tc0, the lower bit b3 of the printing signal SI[m] is always "1", and the selection signal Sc is set to the high level H and the selection signals Sa and Sb are set to the low level L regardless of the values of the higher bit b1 and the medium bit b2.

The description returns to FIG. 15. As shown in FIG. 15, the drive signal generation unit 51 includes M sets of transmission gates TGa, TGb and TGc so as to correspond one-to-one to the M discharge units 35.

The transmission gate TGa is turned on when the selection signal Sa is at the H level and is turned off when the selection signal Sa is at the L level. The transmission gate TGb is turned on when the selection signal Sb is at the H level and is turned off when the selection signal Sb is at the L level. The transmission gate TGc is turned on when the selection signal Sc is at the H level and is turned off when the selection signal Sc is at the L level.

For example, when content shown by the printing signal SI[m] is that (b1, b2, b3)=(1, 0, 0) in the m-th stage, the transmission gate TGa is turned on and the transmission gates TGb and TGc are turned off in the control period Tc1. In addition, the transmission gates TGa and TGc are turned off and the transmission gate TGb is turned on in the control periods Tc2 and Tc3.

The drive waveform signal Com-A is supplied to one end of the transmission gate TGa, the drive waveform signal Com-B is supplied to one end of the transmission gate TGb, and the drive waveform signal Com-C is supplied to one end of the transmission gate TGc. In addition, the other ends of the transmission gates TGa, TGb and TGc are connected to each other.

The transmission gates TGa, TGb and TGc are exclusively turned on, and the drive waveform signal Com-A, Com-B, or Com-C which is selected for each control period Tc1 or Tc2 is output as the drive signal Vin[m], and the drive signal Vin[m] is supplied to the discharge unit 35 in the m-th stage through the switching unit 53.

Figure 18:
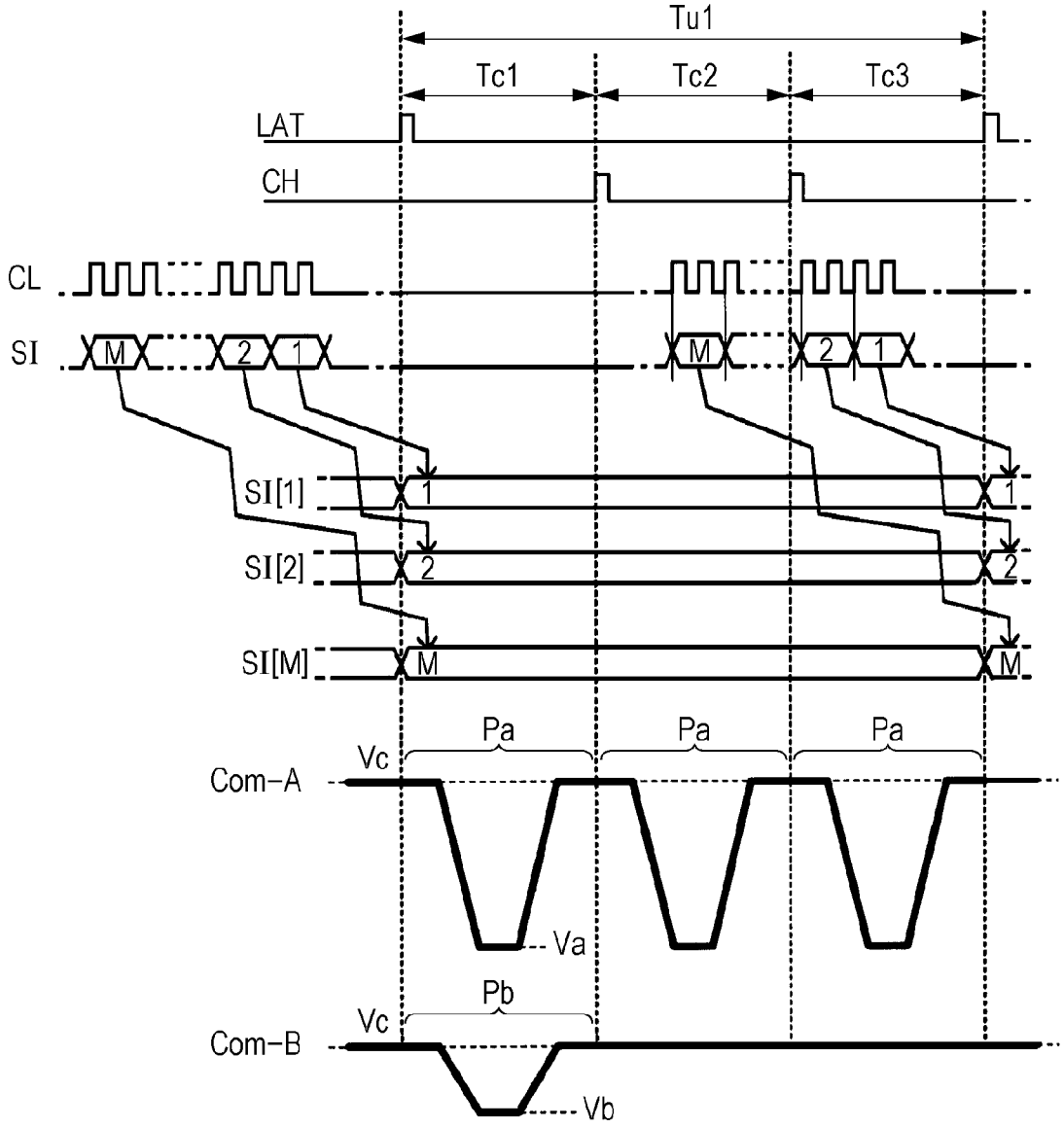
FIG. 18 is a timing chart illustrating the operation of the drive signal generation unit in a first unit operation period.

As shown in FIG. 18, in the first unit operation period Tu1, the drive waveform signal Com-A, which is supplied from the control unit 6, includes a drive pulse Pa which is arranged for each of the control periods Tc1, Tc2, and Tc3 of the first unit operation period Tu1. At a timing at which the drive pulse Pa starts or ends, every potential becomes a reference potential Vc, and the drive pulse Pa has a waveform which drops to a potential Va on the way. In this example, since the same drive pulse Pa is arranged in each of the control periods Tc1, Tc2, and Tc3, the amount of ink, which is discharged from the nozzle N included in the discharge unit 35, is equivalent when the piezoelectric elements 200 included in each discharge unit 35 is driven by the drive pulse Pa.

Meanwhile, there is a case in which the pulse in the embodiment means the waveform of a signal in a predetermined period, and includes a section in which the level of the signal is regular.

Subsequently, the drive waveform signal Com-B, which is supplied from the control unit 6 in the first unit operation period Tu1, is a waveform in which a micro-vibration pulse Pb arranged in the control period Tc1 and a reference potential Vc arranged in the control periods Tc2 and Tc3 are continued. Every potential at a timing in which the micro-vibration pulse Pb starts and ends is the reference potential Vc. The potential difference between the potential Vb of the micro-vibration pulse and the reference potential Vc is less than the potential difference between the potential Va of the drive pulse Pa and the reference potential Vc. Further, even when the piezoelectric elements 200 included in each discharge unit 35 is driven based on the micro-vibration pulse Pb, ink is not discharged from the nozzle N included in the discharge unit 35. When the micro-vibration pulse Pb is applied to the piezoelectric elements 200, it is possible to moderately stir ink and to prevent ink from being thickened.

Figure 19:
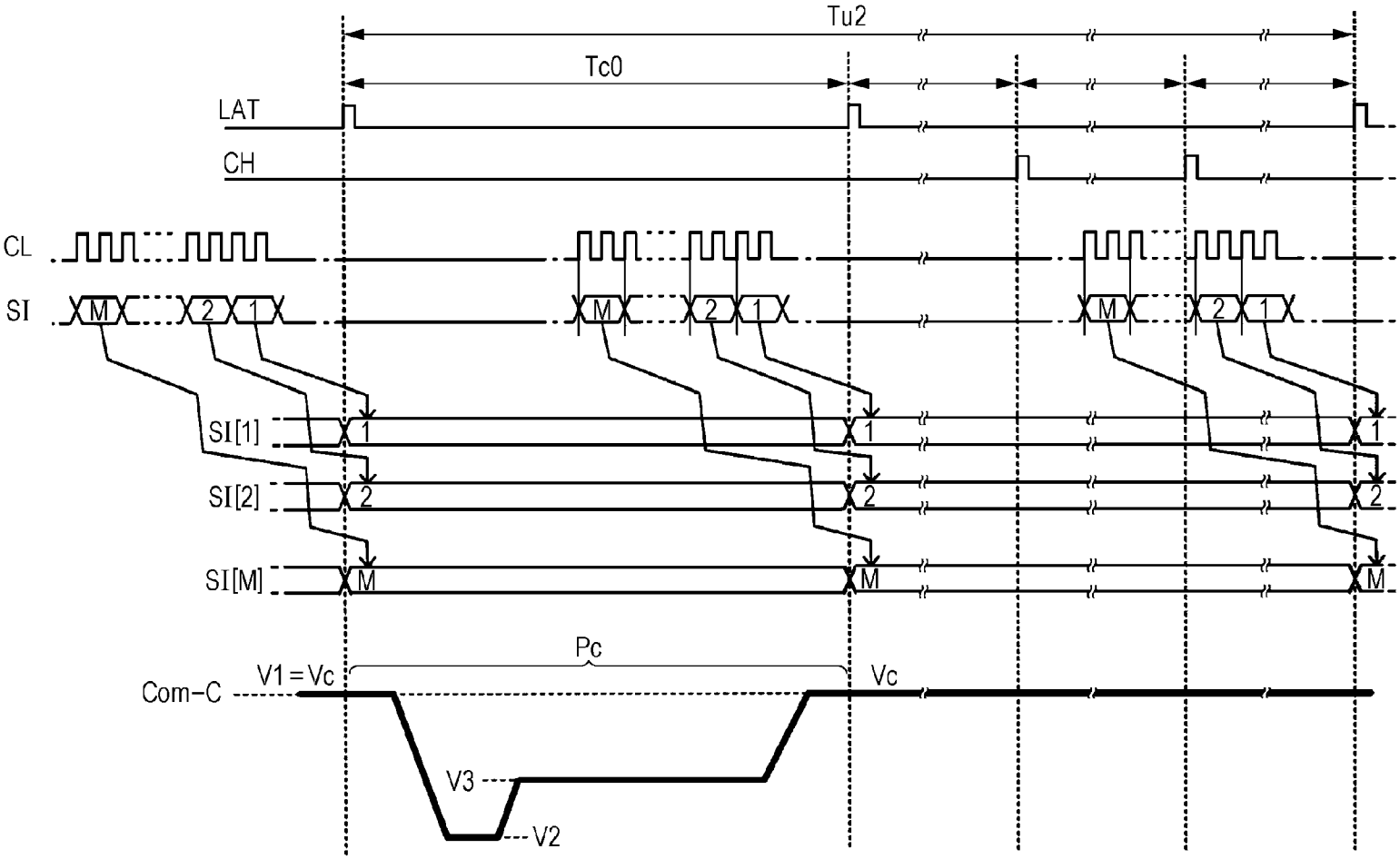
FIG. 19 is a timing chart illustrating the operation of the drive signal generation unit in a second unit operation period.

Subsequently, as shown in FIG. 19, the drive waveform signal Com-C which is supplied from the control unit 6 in the second unit operation period Tu2 is a waveform in which an inspection pulse Pc arranged in the control period Tc0 and a reference potential Vc arranged in the control periods Tc1 to Tc3 are continued. Every potential at a timing in which the inspection pulse Pc starts and ends is the first potential V1 (in the example, the reference potential Vc). The inspection pulse Pc is changed from the first potential V1 to the second potential V2, further, is changed from the second potential V2 to the third potential V3, and maintains the third potential V3. In addition, after the inspection pulse Pc maintains the third potential V3, the inspection pulse Pc is changed from the third potential V3 to the first potential V1, and maintains the first potential V1. The drive waveform signal Com-C is selected when the ink discharge state is inspected. Meanwhile, the first potential (reference potential Vc) of the example is set to a potential which should be held by the piezoelectric elements 200 when ink is not discharged.

As described above, the M latch circuits LT output the printing signals SI[1], SI[2], . . . , and SI[M] at a timing in which the latch signal LAT rises.

In addition, as described above, the decoder DC in the m-th stage outputs the selection signals Sa, Sb, and Sc based on the content of the table shown in FIG. 17 in the respective control periods Tc0 to Tc3 according to the printing signal SI[m].

In addition, as described above, the transmission gates TGa, TGb and TGc in the m-th stage select any one of the drive waveform signals Com-A, Com-B, and Com-C based on the selection signals Sa, Sb, and Sc, and output the selected drive waveform signal Com as the drive signal Vin[m].

The waveform of the drive signal Vin, which is output by the drive signal generation unit 51, in the first unit operation period Tu1 will be described with reference to FIGS. 15 to 19 and 20.

When the content of the printing signal SI[m], which is supplied in the first unit operation period Tu1, is that (b1, b2, b3)=(1, 1, 0), the selection signals Sa, Sb, and Sc are respectively at the H level, the L level, and the L level in the respective control periods Tc1 to Tc3, with the result that the drive waveform signal Com-A is selected by the transmission gate TGa, and thus the drive pulse Pa is output as the drive signal Vin[m].

As a result, the discharge unit 35 in the m-th stage discharges ink based on three drive pulses Pa in the first unit operation period Tu1, with the result that ink which is discharged three times is combined with the recording sheet P, and thus a large dot is formed on the recording sheet P.

When the content of the printing signal SI[m], which is supplied in the first unit operation period Tu1, is that (b1, b2, b3)=(1, 0, 0), the selection signals Sa, Sb, and Sc are respectively at the H level, the L level, and the L level in the control periods Tc1 and Tc2, the drive waveform signal Com-A is selected by the transmission gate TGa, and two drive pulses Pa are output as the drive signal Vin[m]. In addition, since the selection signals Sa, Sb, and Sc are respectively at the L level, the H level, and the L level in the control period Tc3, the drive waveform signal Com-B is selected by the transmission gate TGb, and thus the reference potential Vc is output as the drive signal Vin[m].

As a result, the discharge unit 35 in the m-th stage discharges ink based on two drive pulses Pa in the first unit operation period Tu1, with the result that ink which is discharged two times is combined with the recording sheet P, and thus a medium dot is formed on the recording sheet P.

When the content of the printing signal SI[m], which is supplied in the first unit operation period Tu1, is that (b1, b2, b3)=(0, 1, 0), the selection signals Sa, Sb, and Sc are respectively at the H level, the L level, and the L level in the control period Tc1, with the result that the drive waveform signal Com-A is selected by the transmission gate TGb, and thus one drive pulse Pa is output as the drive signal Vin[m]. In addition, since the selection signals Sa and Sb are respectively at the L level, the H level, and the L level in the control periods Tc2 and Tc3, the drive waveform signal Com-B is selected by the transmission gate TGb, and thus the reference potential Vc is output as the drive signal Vin[m].

As a result, the discharge unit 35 in the m-th stage discharges a small amount of ink based on the one drive pulse Pa in the first unit operation period Tu1, and thus a small dot is formed on the recording sheet P.

When the content of the printing signal SI[m], which is supplied in the first unit operation period Tu1, is that (b1, b2, b3)=(0, 0, 0), the selection signals Sa, Sb, and Sc are respectively at the L level, the H level, and the L level in each of the control periods Tc1 to Tc3, with the result that the drive waveform signal Com-B is selected by the transmission gate TGb, and thus one drive pulse Pb is output as the drive signal Vin[m].

As a result, the discharge unit 35 in the m-th stage does not discharge ink in the first unit operation period Tu1, and thus a dot is not formed (non-recording) on the recording sheet P.

That is, in the first mode in which printing is performed at the first printing speed, the drive pulse Pa is caused to be applied to the piezoelectric elements 200 (when ink is discharged, the drive pulse Pa is necessarily included), and an inspection pulse Pc is caused not to be applied to the piezoelectric elements 200.

Figure 21:
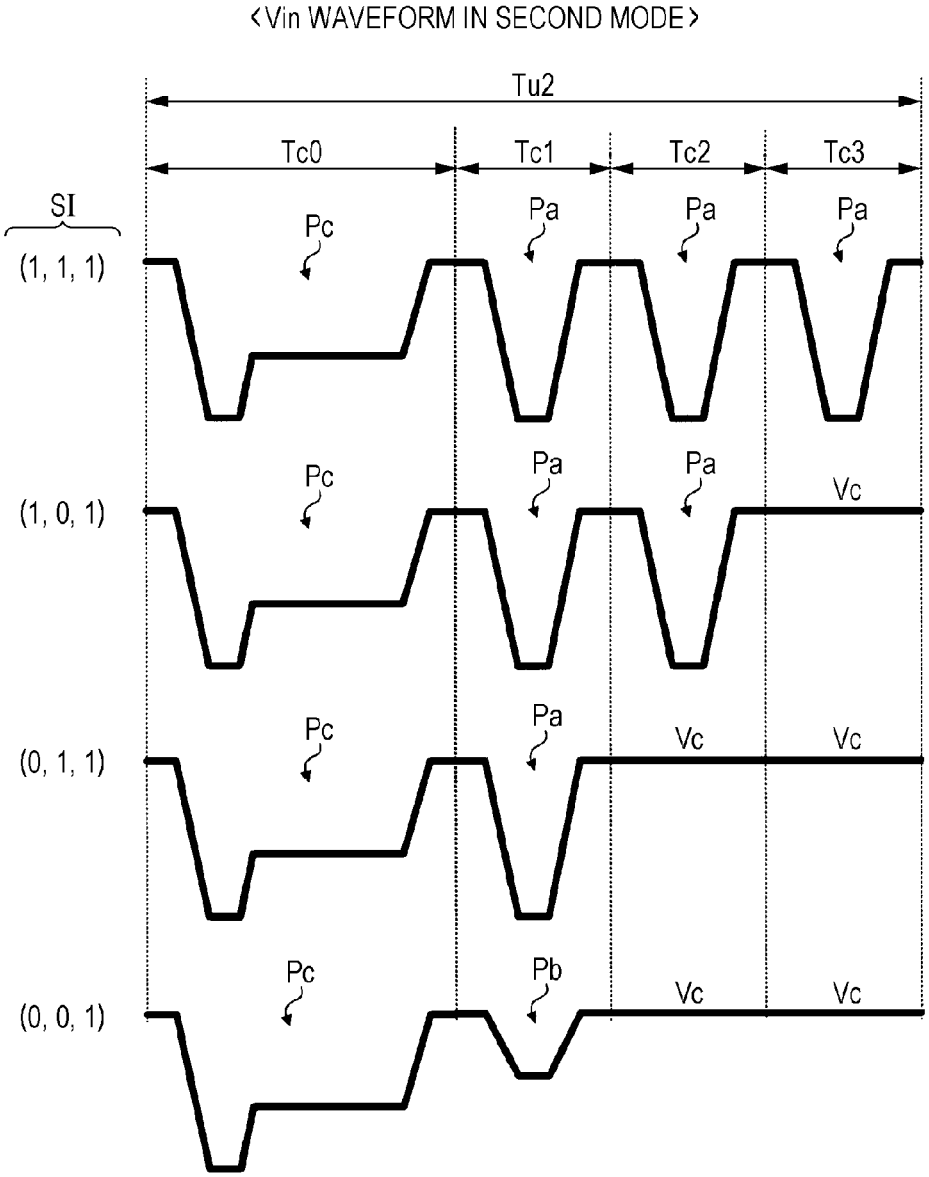
FIG. 21 is a timing chart illustrating the waveform of a drive signal in the second unit operation period.

The waveform of the drive signal Vin, which is output by the drive signal generation unit 51, in the second unit operation period Tu2 will be described with reference to FIG. 21 in addition to FIGS. 15 to 19.

In the control period Tc0 of the second unit operation period Tu2, the lower bit b3 of the printing signal SI[m] is "1", and thus the selection signals Sa, Sb, and Sc are respectively at the L level, the L level, and the H level regardless the values of the higher bit b1 and the medium bit b2. Therefore, the drive waveform signal Com-C is selected by the transmission gate TGc, and the inspection pulse Pc is output as the drive signal Vin[m].

Since the second unit operation period Tu2 is longer than the first unit operation period Tu1, the total discharge amount of liquid which is discharged from the nozzle N per unit time is greater at the first printing speed than at the second printing speed. In addition, the number of times of discharge of liquid which is discharged from the nozzle N per unit time is greater at the first printing speed than at the second printing speed.

Figure 20:
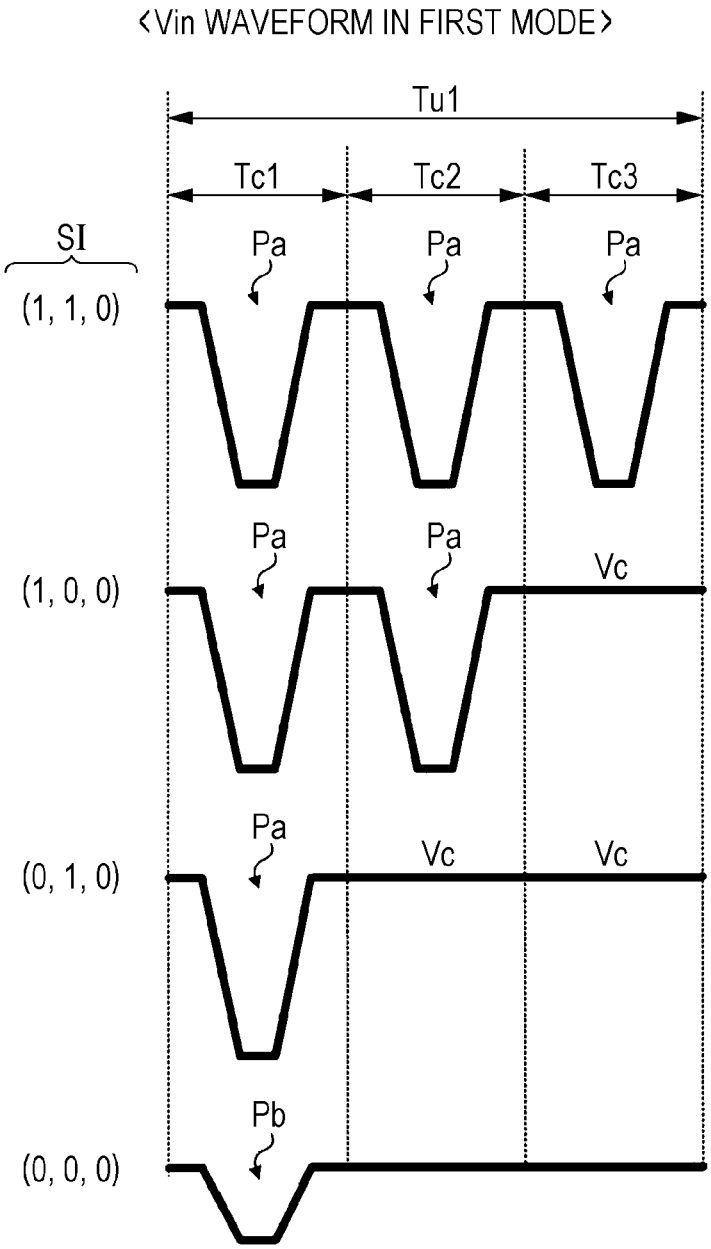
FIG. 20 is a timing chart illustrating the waveform of a drive signal in the first unit operation period.

In addition, since an operation performed in the control periods Tc1 to Tc3 of the second unit operation period Tu2 is the same as the operation performed in the above-described first unit operation period Tu1, the same waveform as in the control periods Tc1 to Tc3 shown in FIG. 20 is acquired. Therefore, in the second mode, it is possible to generate the drive signal Vin to which the inspection pulse Pc is added. As a result, in the second mode, it is possible to inspect the ink discharge state when the printing is being performed. It is possible to apply the drive pulse Pa and the inspection pulse Pc to the piezoelectric elements 200 at the second printing speed.

In order to inspect the ink discharge state when the printing is being performed, it is necessary to use a non-discharge inspection pulse Pc. However, the inspection pulse Pc in the example does not contribute to the printing, and the drive signal Vin[m] which includes the inspection pulse Pc causes the amount of printing per unit time to be reduced.

In contrast, it is not necessary to always grasp the ink discharge state, and the inspection may be sufficiently performed at predetermined intervals.

Figure 22:
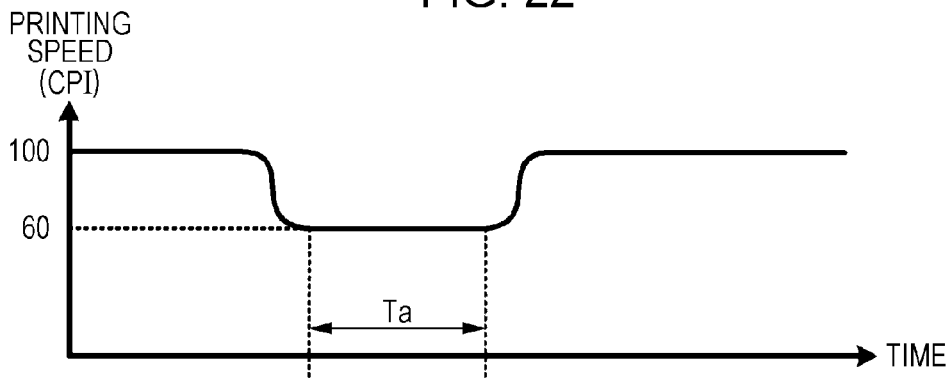
FIG. 22 is an explanatory view illustrating change in printing speed.

Here, in the embodiment, the ink jet printer 1 is operated in the first mode in which the drive pulse Pa is included but the inspection pulse Pc is not included and in the second mode in which the drive pulse Pa and the inspection pulse Pc are included, and thus the amount of printing per unit time is prevented from being reduced and the inspection of the ink discharge state is realized. For example, when it is assumed that the first printing speed is 100 Characters Per Inch (CPI) and the second printing speed is 60 CPI as shown in FIG. 22, it is not necessary to always perform an operation at 60 CPI. That is, throughput is improved by causing a period at 100 CPI to be as long as possible and the printing speed is reduced at a timing in which the inspection is necessary. Further, in a period Ta in which the printing speed is 60 CPI (second printing speed), the ink discharge state is inspected when the printing is being performed.

Here, it is preferable to change the printing speed such that the printing speed decreases from the first printing speed to the second printing speed in a monotonic manner and increases from the second printing speed to the first printing speed in the monotonic manner when viewed from improvement of printing efficiency.

Meanwhile, in a period in which the printing speed is changed from the first printing speed to the second printing speed and a period in which the printing speed is changed from the second printing speed to the first printing speed, the inspection pulse Pc is caused not to be applied to the piezoelectric elements 200 and the drive pulse Pa is caused to be applied to the piezoelectric elements 200 similarly to in the first mode. Further, the cycle of the latch signal LAT is changed in synchronization with the printing speed.

Figure 23:
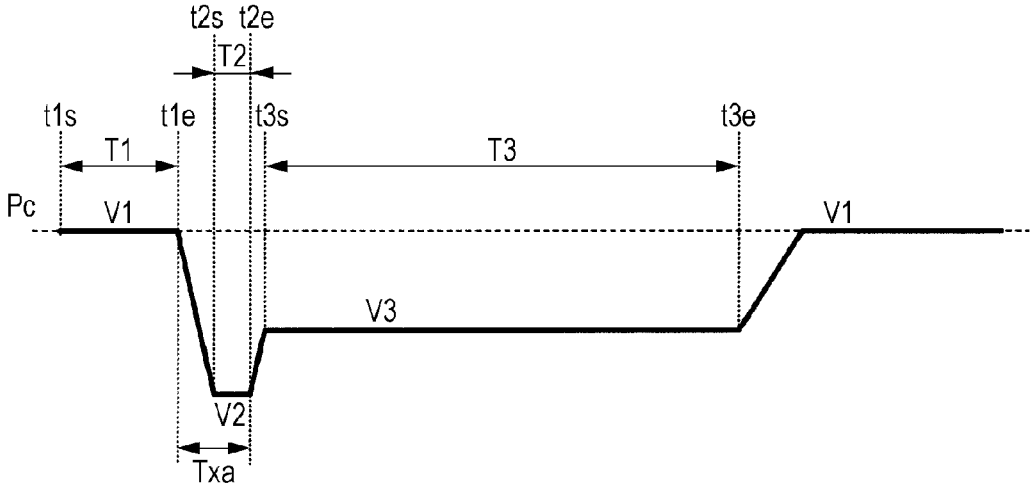
FIG. 23 is a waveform chart illustrating a waveform of an inspection pulse.

Subsequently, the inspection pulse Pc will be described with reference to FIG. 23. As shown in the drawing, the inspection pulse Pc has a first potential V1 in a first period T1 ranging from a time t1s to a time t1e, has a second potential V2 in the second period T2 ranging from a time t2s to a time t2e, and has a third potential V3 in a third period T3 ranging from a time t3s to a time t3e. In addition, the drive signal Vin[m] moves from the first potential V1 to the second potential V2 (t1e to t2s), and moves from the second potential V2 to the third potential V3 (t2e to t3s).

In the example, an electric charge, which is charged in the piezoelectric elements 200 during a time t1e to t2s in which the first potential V1 is changed to the second potential V2, is discharged. As a result, the piezoelectric elements 200 are excited such that a meniscus is drawn into the cavity 245. Thereafter, in the second period T2, the second potential V2 is held, and the second potential V2 is changed to the third potential V3 during the time t2e to the time t3s. In a period of the time t2e to the time t3s, the piezoelectric elements 200 are charged with the electric charge. As a result, the piezoelectric elements 200 are displaced in a direction in which the meniscus is extruded to the outside of the cavity 245. However, the third potential V3 is set such that ink is not discharged from the nozzle N. If the second potential V2 is changed to the first potential V1, the displacement of the piezoelectric elements 200 returns to an original state in a short time, and thus ink is discharged.

Here, in the embodiment, setting is performed such that the third potential V3 is a potential between the first potential V1 and the second potential V2. That is, in the example, from a state in which a meniscus is drawn into the cavity 245 as much as possible, the meniscus is caused to return to an original state such that ink is not discharged, and thus a large change in pressure is generated in the cavity 245. Therefore, it is possible to extract residual vibration with large amplitude.

In addition, in the embodiment, when it is assumed that a time from the termination time t1e of the first period T1 to the termination time t2e of the second period T2 is Txa and when it is assumed that a unique vibration cycle of the cavity 245 is Tc, it is preferable to determine a time Txa as below.

Figure 24:
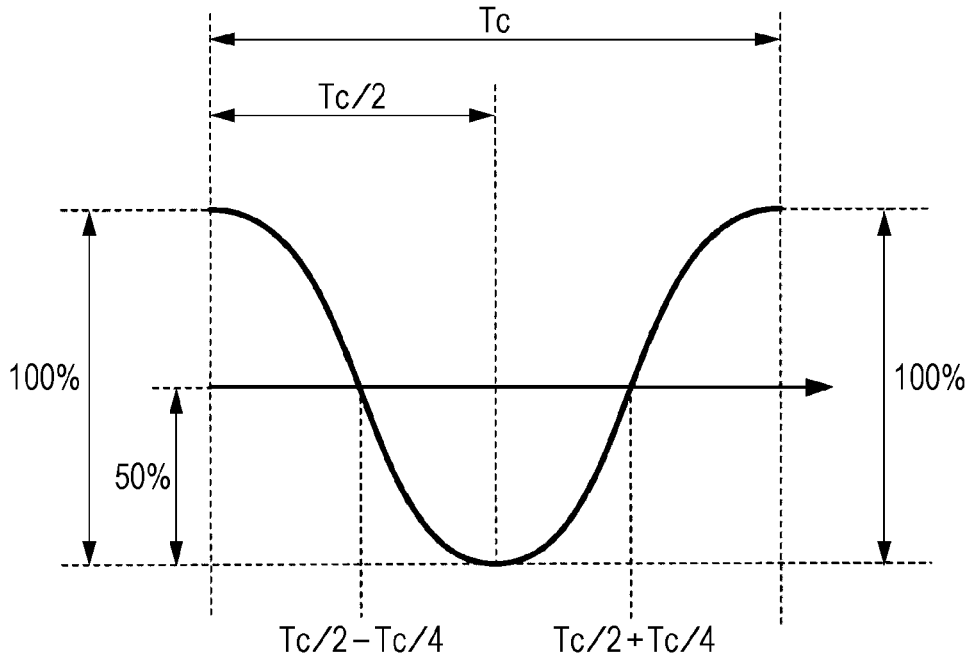
FIG. 24 is an explanatory view illustrating change in pressure of a cavity.

When the piezoelectric elements 200 are bent, the ink in the cavity 245 is excited. At this time, pressure in the cavity 245 increases or decreases in synchronization with the unique vibration cycle Tc. In contrast, the termination time t2e of the second period T2 is a timing in which the direction of the displacement of the piezoelectric elements 200 is changed. In order to acquire large residual vibration, it is preferable to change the direction of the displacement of the piezoelectric elements 200 in synchronization with the change in pressure in the cavity 245. In this case, as shown in FIG. 24, the pressure in the cavity is changed from the decrease to the increase at a timing in which the time Txa is equivalent to Tc/2. Accordingly, it is preferable that the time Txa be equivalent to Tc/2.

In addition, a period from [Tc/2−Tc/4] to [Tc/2+Tc/4] is in a range of 50% of the maximum amplitude. Accordingly, when setting is made such that the time Txa satisfies Expression 1 below, it is possible to improve efficiency compared to a case in which the time Txa is included in a range from [0] to [Tc/2−Tc/4] or a range from [Tc/2+Tc/4] to [Tc].

$$Tc/2-Tc/4<Txa<Tc/2+Tc/4 \quad (1)$$

In addition, in particular, the range from Tc/2 to Tc/2+Tc/4 is acquired after pressure is changed from the decrease to the increase, and thus it is further possible to improve efficiency by setting the time Txa in the range.

However, the abnormal discharge detection unit 52 detects residual vibration in the third period T3. Further, the third period T3 is longer than the second period T2 such that residual vibration can be sufficiently detected. In addition, when residual vibration is analyzed, the actual detection of the unique vibration cycle Tc of the cavity 245 is important in order to specify the ink discharge state. Accordingly, setting is made such that the third period T3 is longer than the unique vibration cycle Tc.

Further, when the ink discharge state is inspected, the residual vibration is positively used. However, if the influence of residual vibration, which is generated in an immediately preceding unit operation period Tu, is received in normal printing, there is a case in which the discharge of ink is negatively affected. Here, it is preferable to determine the length of the third period T3 such that residual vibration is denied. More specifically, the third period T3 may be set to a multiple of natural number of the unique vibration cycle Tc. In addition, similarly to the above-described setting of the time Txa, it is possible to effectively cancel residual vibration by making setting such that the third period T3 satisfies Expression 2.

$$k\cdot Tc-Tc/4<T3<k\cdot Tc+Tc/4 \quad (2)$$

where k is a natural number

The ink jet printer 1 according to the embodiment drives the discharge unit 35 using the inspection drive signal Vin, and detects the change in the electromotive force of the piezoelectric elements 200 as the residual vibration signal Vout based on the change in pressure in the cavity 245 of the discharge unit 35, which is generated as a result of drive. Further, an abnormal discharge detection process is performed to determine whether or not abnormal discharge occurs in the discharge unit 35 based on the residual vibration signal Vout.

Figure 25:
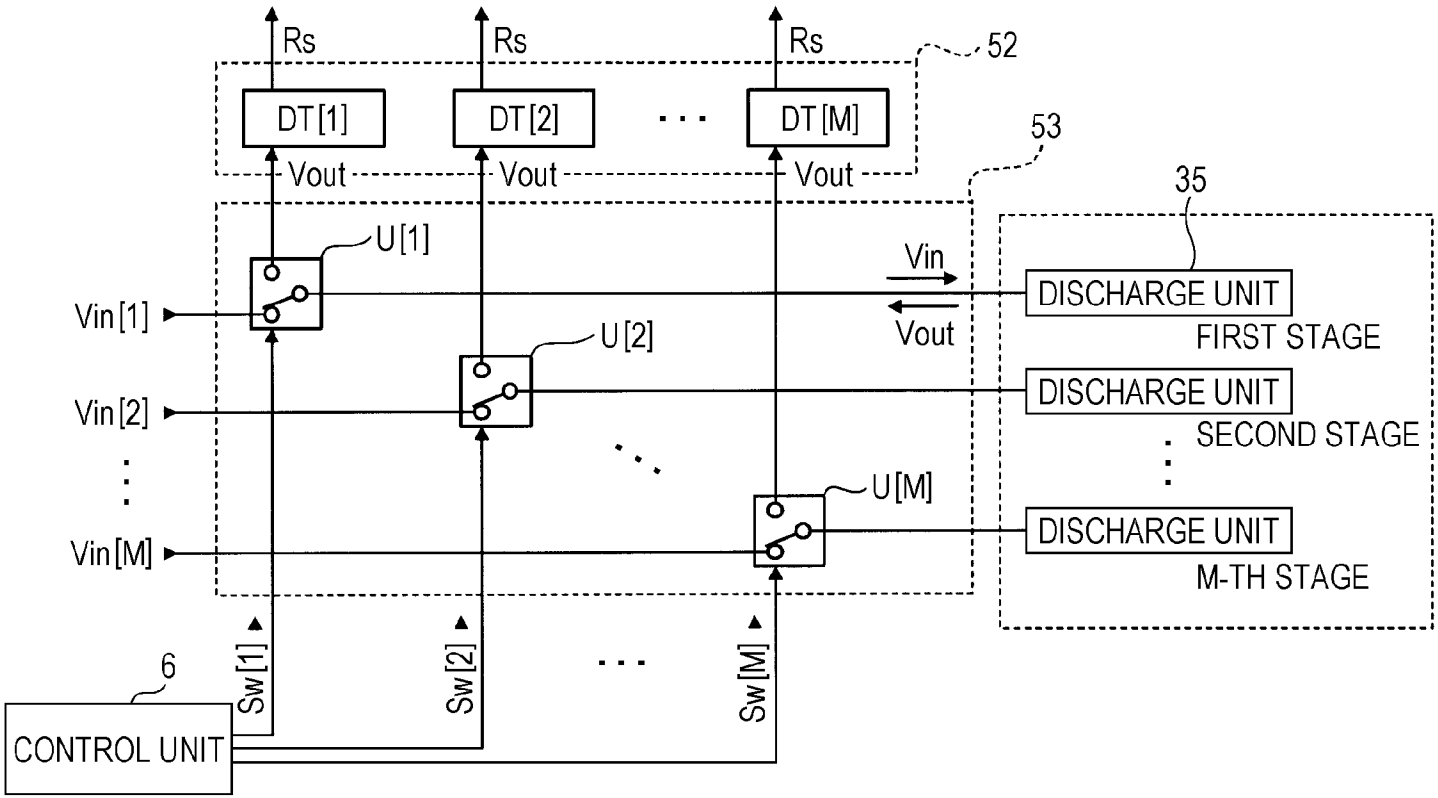
FIG. 25 is a block diagram illustrating a configuration of a switching unit.

FIG. 25 is a block diagram illustrating the configuration of the switching unit 53 of the head driver 50, and an electrical connection relationship between the switching unit 53, the abnormal discharge detection unit 52, the head unit 30, and the drive signal generation unit 51.

As shown in FIG. 25, the switching unit 53 includes M switching circuits U (U[1], U[2], . . . , and U[M]) in the first stage to the M-th stage, which correspond one-to-one to the M discharge units 35. A switching circuit U[m] in the m-th stage electrically connect the discharge unit 35 in the m-th stage to either a wiring, to which the drive signal Vin[m] is supplied, or the abnormal discharge detection circuit DT which is included in the abnormal discharge detection unit 52.

Hereinafter, in each switching circuit U, a state in which the discharge unit 35 is electrically connected to the drive signal generation unit 51 is called a first connection state. In addition, a state in which the discharge unit 35 is electrically connected to the abnormal discharge detection circuit DT of the abnormal discharge detection unit 52 is called a second connection state.

The control unit 6 supplies a switching control signal Sw[m] for controlling the connection state of the switching circuit U[m] to the switching circuit U[m] in the m-th stage.

More specifically, in the unit operation period Tu, the control unit 6 outputs switching control signals Sw[1], Sw[2], . . . , and Sw[M] such that the switching circuit corresponding to the discharge unit 35 which performs printing is in a first connection state and the switching circuit corresponding to the discharge unit 35 which is a target of inspection is in a second connection state. That is, in the unit operation period Tu, the switching control signals Sw which designate the first connection state and the second connection state may be mixed, all of the switching control signals Sw may designate the first connection state, and all of the switching control signals Sw may designate the second connection state.

Figure 26:
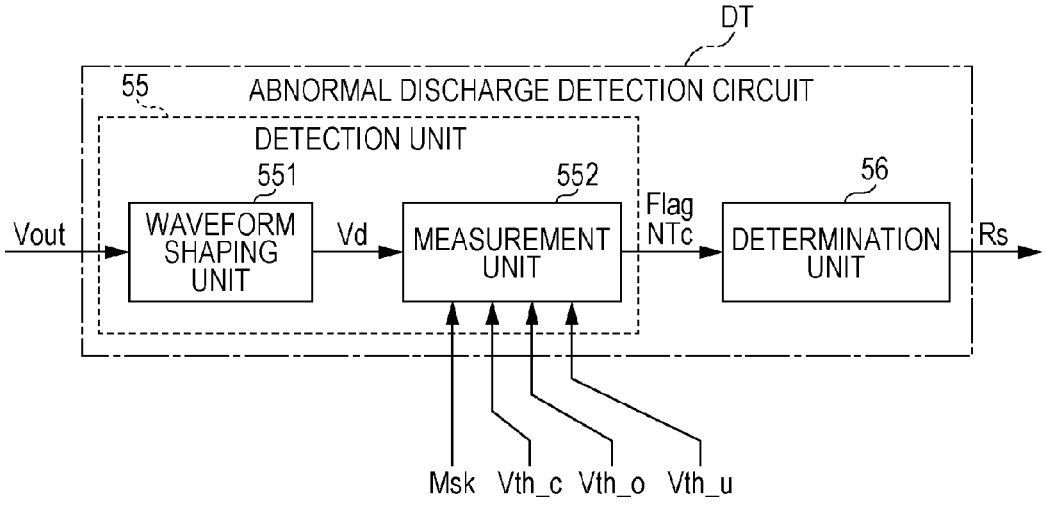
FIG. 26 is a block diagram illustrating a configuration of an abnormal discharge detection circuit.

FIG. 26 is a block diagram illustrating the configuration of the abnormal discharge detection circuit DT which is included in the abnormal discharge detection unit 52 of the head driver 50.

As shown in FIG. 26, the abnormal discharge detection circuit DT includes a detection unit 55 which outputs a detection signal NTc for indicating a time length corresponding to one cycle of residual vibration of the discharge unit 35 based on the residual vibration signal Vout, and a determination unit 56 which determines whether or not abnormal discharge occurs in the discharge unit 35 based on the detection signal NTc, which determines the discharge state of the discharge unit 35 when abnormal discharge occurs, and which outputs a determination result signal Rs for indicating a result of the determination.

Here, the detection unit 55 includes a waveform shaping unit 551 which generates a shaped waveform signal Vd acquired by removing noise components from the residual vibration signal Vout output from the discharge unit 35, and a measurement unit 552 which generates the detection signal NTc based on the shaped waveform signal Vd.

The waveform shaping unit 551 includes, for example, a high-pass filter which outputs a signal acquired by attenuating frequency components in a band lower than the frequency band of the residual vibration signal Vout, and a low-pass filter which outputs a signal acquired by attenuating frequency components in a band higher than the frequency band of the residual vibration signal Vout, and is configured to be capable of outputting the shaped waveform signal Vd which limits the frequency range of the residual vibration signal Vout and which is acquired by removing noise components.

In addition, the waveform shaping unit 551 may be configured to include a negative feedback type fan which adjusts the amplitude of the residual vibration signal Vout, and a voltage follower which performs conversion on the impedance of the residual vibration signal Vout and outputs the shaped waveform signal Vd having low impedance.

The measurement unit 552 receives the shaped waveform signal Vd obtained by shaping the residual vibration signal Vout in the waveform shaping unit 551, a mask signal Msk which is generated by the control unit 6, a threshold potential Vth_c which is prescribed as a potential at a central amplitude level of the shaped waveform signal Vd, a threshold potential Vth_o which is prescribed as a potential higher than the threshold potential Vth_c, and a threshold potential Vth_u which is prescribed as a potential lower than the threshold potential Vth_c. The measurement unit 552 outputs a validation flag Flag which indicates whether or not the detection signal NTc and the detection signal NTc are valid values based on the signals.

Figure 27:
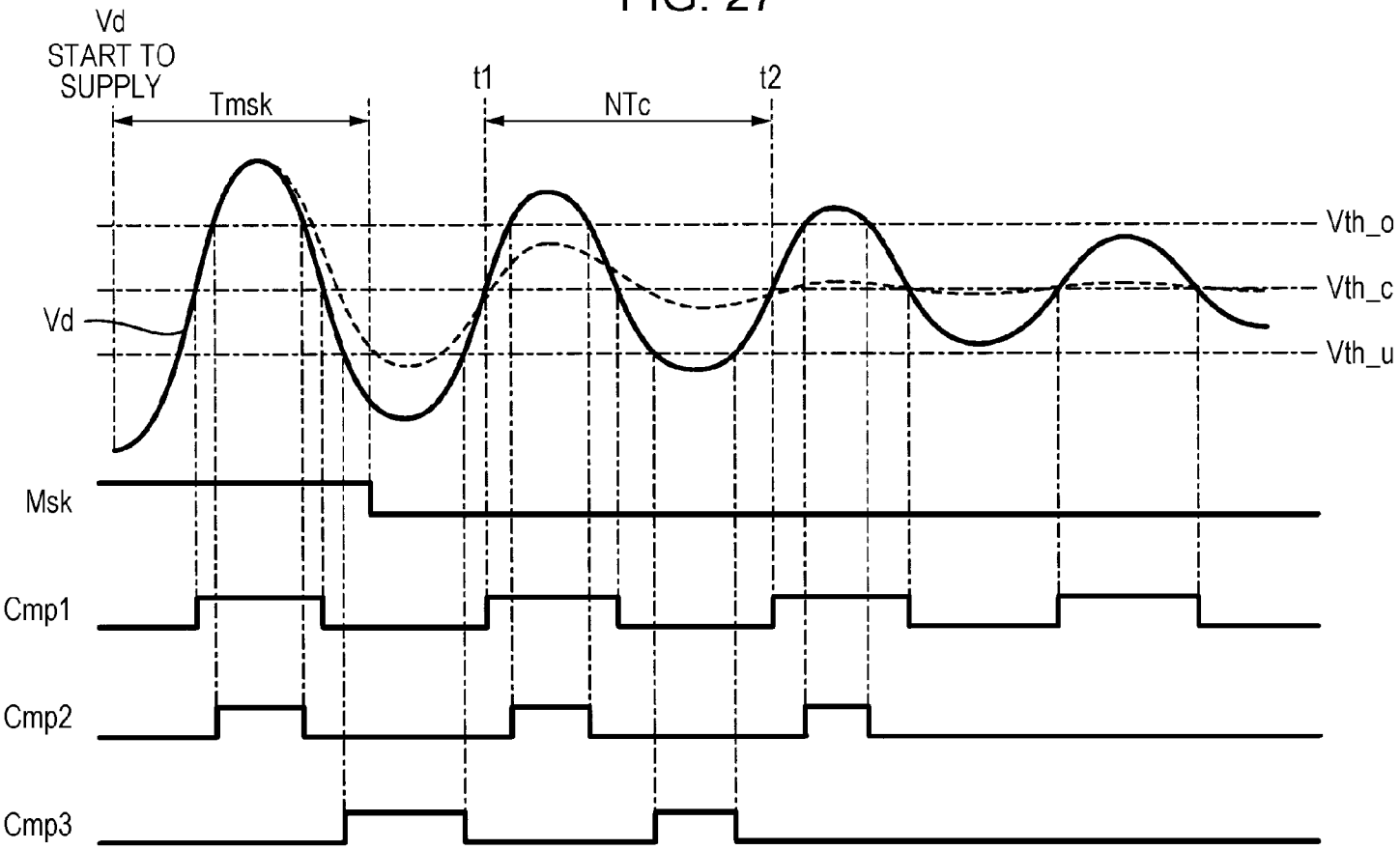
FIG. 27 is a timing chart illustrating the operation of the abnormal discharge detection circuit.

FIG. 27 is a timing chart illustrating an operation of the measurement unit 552.

As shown in the drawing, the measurement unit 552 compares the potential indicated by the shaped waveform signal Vd with the threshold potential Vth_c, and generates a comparison signal Cmp1 which is at a high level when the potential indicated by the shaped waveform signal Vd is equal to or greater than the threshold potential Vth_c and is at a low level when the potential indicated by the shaped waveform signal Vd is less than the threshold potential Vth_c.

In addition, the measurement unit 552 compares the potential indicated by the shaped waveform signal Vd with the threshold potential Vth_o, and generates a comparison signal Cmp2 which is at a high level when the potential indicated by the shaped waveform signal Vd is equal to or greater than the threshold potential Vth_o and is at a low level when the potential indicated by the shaped waveform signal Vd is less than the threshold potential Vth_o.

In addition, the measurement unit 552 compares a potential indicated by the shaped waveform signal Vd with the threshold potential Vth_u, and generates a comparison signal Cmp3 which is at a high level when a potential indicated by the shaped waveform signal Vd is less than the threshold potential Vth_u and which is at a low level when the potential indicated by the shaped waveform signal Vd is equal to or greater than the threshold potential Vth_u.

The mask signal Msk is a signal which is at the high level for only a predetermined period Tmsk from when the waveform shaping unit 551 starts to supply the shaped waveform signal Vd. In the embodiment, the detection signal NTc is generated with only the shaped waveform signal Vd, as a target which is acquired after the period Tmsk elapses, of the shaped waveform signal Vd, and thus it is possible to acquire the highly accurate detection signal NTc from which noise components, superimposed immediately after the residual vibration starts, are removed.

The measurement unit 552 includes a counter (not shown in the drawing). The counter starts to count a clock signal (not shown in the drawing) at a time t1 which is a timing in which the potential indicated by the shaped waveform signal Vd is initially equivalent to the threshold potential Vth_c after the mask signal Msk falls down to the low level. That is, the counter starts to count at a timing in which the comparison signal Cmp1 initially rises to the high level after the mask signal Msk falls down to the low level or at the time t1 which is the faster timing of the timing in which the comparison signal Cmp1 initially falls down to the low level.

Further, after the counter starts to count the clock signal, the counter terminates counting the clock signal at a time t2 which is a timing in which the potential indicated by the shaped waveform signal Vd becomes the threshold potential Vth_c for the second time, and outputs an acquired count value as the detection signal NTc. That is, the counter terminates counting the clock signal at a timing in which the comparison signal Cmp1 rises to the high level for the second time after the mask signal Msk falls down to the low level or at the time t2 or at the time t2 which is the faster timing of the timing in which the comparison signal Cmp1 falls down to the low level for the second time.

As described above, the measurement unit 552 generates the detection signal NTc by measuring a time length from the time t1 to the time t2 as a time length corresponding to one cycle of the shaped waveform signal Vd.

However, when the amplitude of the shaped waveform signal Vd is small as shown in FIG. 27 using a dashed line, there is a strong possibility that it is difficult to accurately measure the detection signal NTc. In addition, when the amplitude of the shaped waveform signal Vd is small, there is a possibility that abnormal discharge actually occurs even if it is determined that the discharge state of the discharge unit 35 is normal based on only the result of the detection signal NTc. For example, when the amplitude of the shaped waveform signal Vd is small, it is considered to be a state in which it is difficult to discharge ink because ink is not injected to the cavity 245.

Here, in the embodiment, it is determined whether or not the amplitude of the shaped waveform signal Vd is large enough to measure the detection signal NTc, and the result of the determination is output as the validation flag Flag.

More specifically, in a period in which counting is performed by the counter, that is, in a period from the time t1 to the time t2, when the potential indicated by the shaped waveform signal Vd is greater than the threshold potential Vth_o and is lower than the threshold signal Vth_u, the measurement unit 552 sets the value of the validation flag Flag to "1" which indicates that the detection signal NTc is valid, sets the value of the validation flag Flag to "0" in the other cases, and outputs the validation flag Flag. More specifically, in the period from the time t1 to the time t2, when the comparison signal Cmp2 rises from the low level to the high level and then falls down to the low level again and when the comparison signal Cmp3 rises from the low level to the high level and then falls down to the low level again, the measurement unit 552 sets the value of the validation flag Flag to "1" and sets the value of the validation flag Flag to "0" in the other cases.

As described above, in the embodiment, the measurement unit 552 generates the detection signal NTc which indicates the time length corresponding to one cycle of the shaped waveform signal Vd, and determines whether or not the amplitude of the shaped waveform signal Vd is large enough to measure the detection signal NTc, and thus it is possible to more accurately detect abnormal discharge.

The determination unit 56 determines the ink discharge state in the discharge unit 35 based on the detection signal NTc and the validation flag Flag, and outputs a result of the determination as the determination result signal Rs.

FIG. 28 is an explanatory view illustrating content of the determination in the determination unit 56. As shown in the drawing, the determination unit 56 respectively compares a time length which is indicated by the detection signal NTc with a threshold NTx1, a threshold NTx2 which indicates a time length longer than that of the threshold NTx1, and a threshold NTx3 which indicates a time length longer than that of the threshold NTx2.

Here, the threshold NTx1 is a value which indicates a boundary between the time length corresponding to one cycle of residual vibration, acquired when a bubble is generated inside the cavity 245 and the frequency of residual vibration is high, and the time length corresponding to one cycle of residual vibration acquired when the discharge state is normal.

In addition, the threshold NTx2 is a value which indicates a boundary between the time length corresponding to one cycle of residual vibration, acquired when paper powder adheres in the vicinity of the outlet of the nozzle N and the frequency of residual vibration is low, and the time length corresponding to one cycle of residual vibration acquired when the discharge state is normal.

In addition, threshold NTx3 is a value which indicates a boundary between the time length corresponding to one cycle of residual vibration, acquired when the frequency of residual vibration is lower than in the case in which paper powder adheres due to ink stuck or thickened in the vicinity of the nozzle N, and the time length corresponding to one cycle of residual vibration acquired when paper powder adheres in the vicinity of the outlet of the nozzle N.

As shown in FIG. 28, when the value of the validation flag Flag is "1" and a condition that "NTx1≤NTcNTx2" is satisfied, the determination unit 56 determines that the ink discharge state in the discharge unit 35 is normal and sets the determination result signal Rs to a value "1" which indicates that the discharge state is normal.

In addition, when the value of the validation flag Flag is "1" and a condition that "NTc<NTx1" is satisfied, the determination unit 56 determines that abnormal discharge occurs due to a bubble which is generated in the cavity 245 and sets the determination result signal Rs to a value "2" which indicates that abnormal discharge occurs due to a bubble.

In addition, when the value of the validation flag Flag is "1" and a condition that "NTx2<NTc≤NTx3" is satisfied, the determination unit 56 determines that abnormal discharge occurs due to paper powder which adheres in the vicinity of the outlet of the nozzle N and sets the determination result signal Rs to a value "3" which indicates that abnormal discharge occurs due to paper powder.

In addition, when the value of the validation flag Flag is "1" and a condition that "NTx3<NTc" is satisfied, the determination unit 56 determines that abnormal discharge occurs due to thickened ink in the vicinity of the nozzle N and sets the determination result signal Rs to a value "4" which indicates that abnormal discharge occurs due to thickened ink.

In addition, when the value of the validation flag Flag is "0" the determination unit 56 sets the determination result signal Rs to a value "5" which indicates that abnormal discharge occurs for some reasons like that ink is not poured in.

As described above, the determination unit 56 determines whether or not abnormal discharge occurs in the discharge unit 35, and outputs a result of the determination as a determination result signal Rs. Therefore, when the abnormal discharge occurs, the control unit 6 can stop the printing process if necessary (strictly speaking, stops the printing operation period), move the head unit 30 to the initial position (X=Xini), and then perform an appropriate recovery process according to an abnormal discharge cause indicated by the determination result signal Rs.

Meanwhile, the determination performed in the determination unit 56 may be performed in the control unit 6 (CPU 61). In this case, the abnormal discharge detection circuit DT of the abnormal discharge detection unit 52 does not include the determination unit 56, and may output the detection signal NTc, which is generated by the detection unit 55, to the control unit 6.

As described above, according to the embodiment, the level of the inspection drive signal Vin is changed from the first potential V1 to the second potential V2, and further, is changed from the second potential V2 to the third potential V3 which is a potential between the first potential V1 and the second potential V2. Therefore, it is possible to apply a large exciting force to ink in the process of changing from the first potential V1 to the second potential V2. Further, a change is performed from the second potential V2 to the third potential V3, with the result that the third potential V3 is held, and thus it is possible to control the internal pressure of the cavity 245 such that the ink is not discharged from the nozzle N while using the exciting force. Therefore, it is possible to acquire large residual vibration without discharging ink from the nozzle N, and thus it is possible to accurately determine the ink discharge state.

C. Modification Example

Each of the above embodiments may modified in various manners. Detailed modification aspects will be shown below. Two or more aspects which are arbitrarily selected from examples below may be appropriately merged with each other in a range in which they do not contradict each other.

First Modification Example

In the above-described embodiment, the inspection drive signal Vin includes three states of the first potential V1, the second potential V2 and the third potential V3. However, the invention is not limited thereto, and the inspection drive signal Vin may have a signal waveform which includes four or more potentials.

For example, as shown in FIG. 29, in a period from the termination time t1e of the first period T1 to the start time t2s of the second period T2, a fourth period T4 in which a fourth potential VA may be maintained is provided, a change is performed from the first potential V1 to the fourth potential VA from the time t1e to the time t4s, and a change is performed from the fourth potential VA to the second potential V2 from the time t4e to the time t2s.

Here, a potential difference ΔV42 between the fourth potential VA and the second potential V2 is greater than a potential difference ΔV12 between the first potential V1 and the second potential V2. Accordingly, compared to the embodiment, it is possible for the inspection drive signal Vin according to the first modification example to cause ink in the cavity 245 to be excited with a larger force. Therefore, the first modification example is effective when the viscosity of ink is great.

In addition, when setting is made such that a time from the termination time t4e of the fourth period T4 to the termination time t2e of the second period T2 is Txb and the unique vibration cycle of the cavity 245 is Tc, it is preferable that the time Txb be Tc/2 due to reasons which are the same as in the above-described embodiment, and, further, the time Txb may satisfy Expression 3 shown below.

$$Tc/2-Tc/4<Txb<Tc/2+Tc/4 \quad (3)$$

In addition, in particular, since the range from Tc/2 to Tc/2+Tc/4 is acquired after the pressure is changed from the decrease to the increase, it is possible to further improve efficiency by setting the time Txb in the range.

Meanwhile, it is preferable that the third period T3 satisfy Expression 2 similarly to the embodiment from a point of view that residual vibration does not affect the subsequent unit operation period Tu.

Second Modification Example

Figure 31:
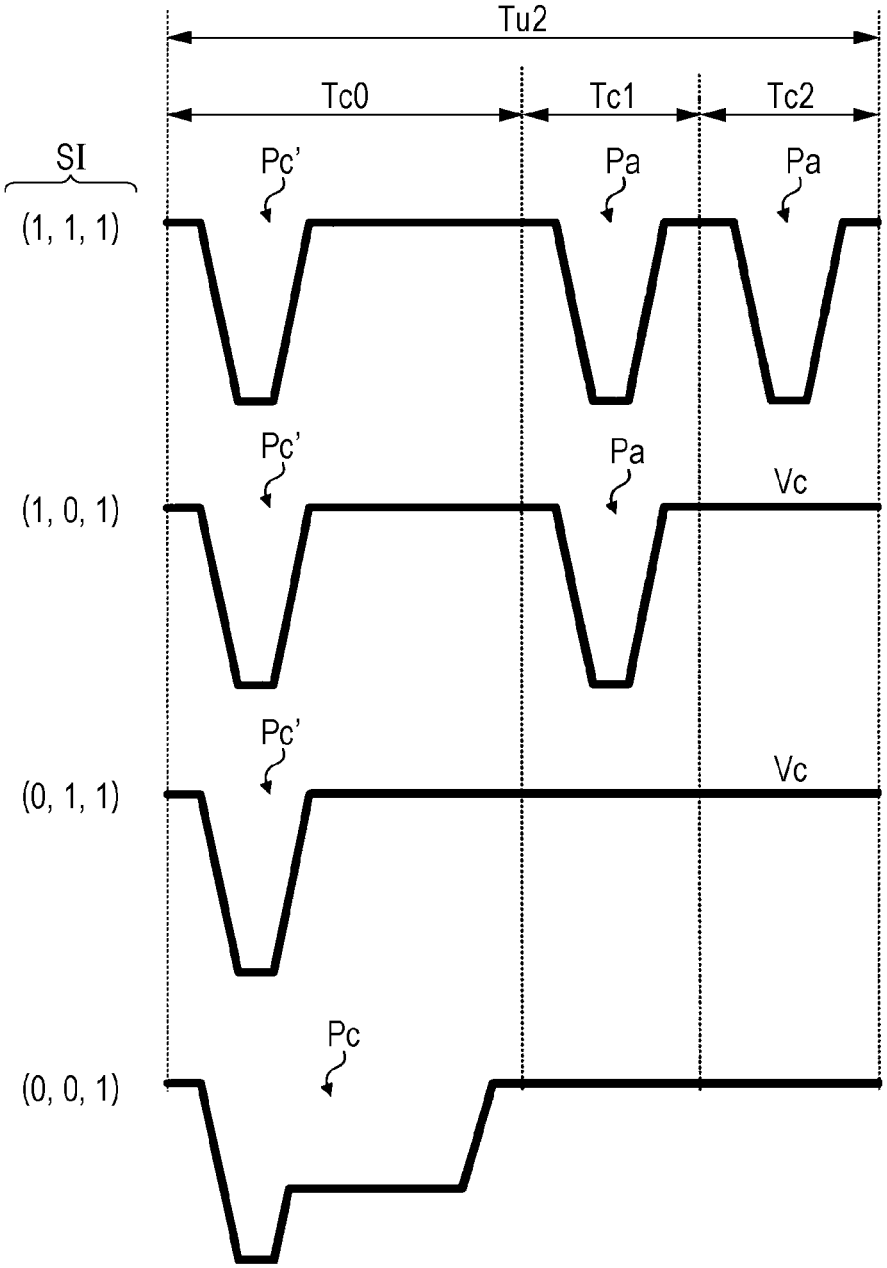
FIG. 31 is a timing chart illustrating a drive signal in the second mode using the inspection pulse according to the modification example.

In the above-described embodiment, a waveform which causes ink not to be discharged is used as the inspection pulse Pc. However, the invention is not limited thereto, and a waveform which causes ink to be discharged may be used. For example, an inspection pulse Pc' shown in FIG. 30 may be used. The inspection pulse Pc' according to the example causes the amount of ink which is the same as that of one drive pulse Pa to be discharged. Accordingly, it is possible to use the inspection pulse Pc' in printing in addition to inspecting the ink discharge state. In this case, the waveform of the drive signal Vin in the second mode may have waveforms as shown in FIG. 31. As shown in FIG. 31, the second unit operation period Tu2 includes control periods Tc0, Tc1, and Tc2, and it is possible to omit the control period Tc3, compared to the waveforms according to the embodiment shown in FIG. 21. However, when the printing signal SI is (0, 0, 0) and indicates non-recording, it is necessary to select a non-discharge inspection pulse Pc in the control period Tc0. As above, it is possible to further improve throughput by switching between the inspection pulse Pc' which causes ink to be discharged and the inspection pulse Pc which causes ink not to be discharged based on whether or not a dot is recorded.

Third Modification Example

In the above-described embodiment, a waveform which causes the same amount of ink to be discharged is used as the drive pulse Pa which is used in each of the control periods Tc1 to Tc3. However, the invention is not limited thereto, and a waveform which causes a different amount of ink to be discharged may be used. For example, a small dot drive pulse Pa1 and a large dot drive pulse Pa2 are generated. Further, in the first mode, ink may be discharged using one drive pulse Pa1 when a small dot is recorded, ink may be discharged using two drive pulses Pa1 when a medium dot is recorded, and ink may be discharged by combining one drive pulse Pa1 with one drive pulse Pa2 when a large dot is recorded. In this case, the inspection pulse Pc' which causes ink to be discharged may be a waveform which includes the drive pulse Pa1. Further, in the second mode, ink may be discharged using one inspection pulse Pc' when a small dot is recorded, ink may be discharged using one inspection pulse Pc' and one drive pulse Pa1 when a medium dot is recorded, ink may be discharged using one inspection pulse Pc' and one drive pulse Pa2 when a large dot is recorded, and the inspection pulse Pc may be used when recording is not performed.

Fourth Modification Example

In the above-described embodiment and modification examples, an ink jet printer is shown as an example of a liquid discharge apparatus which discharges ink as liquid. However, the invention is not limited thereto, and any apparatus which discharges liquid may be included as an example. For example, an apparatus which discharges liquid including various materials (including a dispersion such as a suspension or an emulsion) as below may be included. That is, examples include a filter material (ink) of a color filter, a light emitting material for forming an Electro Luminescence (EL) light emitting layer of an organic EL apparatus, a fluorescent material for forming a fluorescent substance on an electrode of an electron emission apparatus, a fluorescent material for forming a fluorescent substance of a Plasma Display Panel (PDP) apparatus, a migration body material for forming a migration body of an electrophoresis display apparatus, a bank material for forming a bank on a surface of a substrate W, various coating materials, a liquid electrode material for forming an electrode, a particle material included in a space for forming a minute cell gap between two substrates, a liquid metallic material for forming a metallic wiring, a lens material for forming a micro lens, a resistance material, a light diffusion material for forming a light diffusion body, and various experimental liquid materials used for a bio sensor such as a DNA chip or a protein chip.

In addition, in the invention, a liquid reception matter, which is a target to which liquid is discharged, is not limited to paper such as the recording sheet, and may include other mediums, such as a film, a woven fabric, and a non-woven fabric, or a work such as various substrates including a glass substrate, a silicon substrate, and the like.

The entire disclosure of Japanese Patent Application No. 2013-181898, filed Sep. 3, 2013 is expressly incorporated by reference herein.

What is claimed is:

1. A line printer comprising:

a nozzle that discharges liquid;

a pressure chamber that communicates with the nozzle;

a piezoelectric element that is provided to correspond to the pressure chamber and to discharge liquid;

a pulse generation unit that generates a drive pulse to discharge liquid from the nozzle and an inspection pulse to inspect a liquid discharge state; and a residual vibration detection unit that detects change in an electromotive force of the piezoelectric element in accordance with residual vibration in the pressure chamber, which occurs after the inspection pulse is applied to the piezoelectric element, wherein the drive pulse is caused to be applied to the piezoelectric element and the inspection pulse is caused not to be applied to the piezoelectric element at a first printing speed, wherein the drive pulse and the inspection pulse are caused to be applied to the piezoelectric element at a second printing speed, and wherein the second printing speed is slower than the first printing speed.

2. The line printer according to claim 1, further comprising:

a printing speed control unit that changes a transport speed without stopping transporting of a recording medium when the printing speed is changed from the first printing speed to the second printing speed.

3. The line printer according to claim 1, wherein a total discharge amount of liquid which is discharged from the nozzle per unit time is greater at the first printing speed than at the second printing speed.

4. The line printer according to claim 1, wherein the number of times that liquid, which is discharged from the nozzle per unit time, is discharged is greater at the first printing speed than at the second printing speed.

5. The line printer according to claim 1, wherein a waveform which causes ink not to be discharged is used as the inspection pulse when a dot is not recorded at the second printing speed, and a waveform which causes ink to be discharged is used as the inspection pulse when a dot is recorded.

6. A method for controlling a line printer including: a nozzle that discharges liquid; a pressure chamber that communicates with the nozzle; a piezoelectric element that is provided to correspond to the pressure chamber and to discharge liquid; a pulse generation unit that generates a drive pulse to discharge liquid from the nozzle and an inspection pulse to inspect a liquid discharge state; and a residual vibration detection unit that detects change in an electromotive force of the piezoelectric element in accordance with residual vibration in the pressure chamber, which occurs after the inspection pulse is applied to the piezoelectric element, the method comprising:

causing the drive pulse to be applied to the piezoelectric element and causing the inspection pulse not to be applied to the piezoelectric element at a first printing speed;

causing the drive pulse and the inspection pulse to be applied to the piezoelectric element at a second printing speed; and causing the second printing speed to be slower than the first printing speed.

* * * * *